US009208620B1

(12) United States Patent
Bortnak et al.

(10) Patent No.: US 9,208,620 B1
(45) Date of Patent: Dec. 8, 2015

(54) SYSTEMS AND METHODS FOR PAYMENT OF POSTAGE INDICIA AFTER THE POINT OF GENERATION

(75) Inventors: James Michael Bortnak, Santa Barbara, CA (US); Kenneth Thomas McBride, Palos Verdes Estates, CA (US); John Roland Clem, Manhattan Beach, CA (US)

(73) Assignee: Stamps.com, Inc., El Segundo, CA (US)

( * ) Notice: Subject to any disclaimer, the term of this patent is extended or adjusted under 35 U.S.C. 154(b) by 632 days.

(21) Appl. No.: 12/553,824

(22) Filed: Sep. 3, 2009

Related U.S. Application Data

(63) Continuation-in-part of application No. 12/103,496, filed on Apr. 15, 2008.

(51) Int. Cl.
*G07B 17/02* (2006.01)
*G07B 17/00* (2006.01)

(52) U.S. Cl.
CPC ..... *G07B 17/0008* (2013.01)

(58) Field of Classification Search
CPC ..... G07B 17/0008
See application file for complete search history.

(56) References Cited

U.S. PATENT DOCUMENTS

| | | | | |
|---|---|---|---|---|
| 3,584,696 | A | 6/1971 | Eblowitz | |
| 3,594,727 | A | 7/1971 | Braun | |
| 3,691,726 | A | 9/1972 | Stephens et al. | |
| 4,119,194 | A | 10/1978 | Freeman et al. | |
| 4,744,554 | A | 5/1988 | Kulpa et al. | |
| 4,893,249 | A | 1/1990 | Silverberg | |
| 5,067,088 | A | 11/1991 | Schneiderhan | |
| 5,075,862 | A | 12/1991 | Doeberl et al. | |
| 5,077,792 | A | 12/1991 | Herring | |
| 5,510,992 | A | 4/1996 | Kara | |
| 5,612,541 | A | 3/1997 | Hoffmann et al. | |
| 5,612,889 | A | 3/1997 | Pintsov et al. | |
| 5,708,422 | A | 1/1998 | Blonder et al. | |
| 5,729,460 | A | 3/1998 | Plett et al. | |
| 5,768,132 | A * | 6/1998 | Cordery et al. | 705/410 |
| 5,819,240 | A | 10/1998 | Kara | |
| 5,936,885 | A | 8/1999 | Morita et al. | |
| 5,960,418 | A | 9/1999 | Kelly et al. | |
| 5,983,209 | A | 11/1999 | Kara | |

(Continued)

FOREIGN PATENT DOCUMENTS

| | | |
|---|---|---|
| EP | 0571259 A1 | 11/1993 |
| WO | WO-9740472 | 10/1997 |

(Continued)

OTHER PUBLICATIONS

Ford, Colleen, "Frequent Flyer Programs," Australian Accountant, 63, Feb. 1, 1993, pp. 52-58.*

(Continued)

*Primary Examiner* — Nathan Erb
(74) *Attorney, Agent, or Firm* — Norton Rose Fulbright US LLP

(57) ABSTRACT

Systems and methods provide for printing unactivated tokens which can be activated into valid postage indicia at a later time. Monetary liability for postage indicia value is postponed until the token is activated into a postage indicium; thus, the token does not have value and is not valid until activated into indicium. Consequently, a user is not made monetarily liable for printed tokens unless the tokens are activated into postage indicia.

19 Claims, 14 Drawing Sheets

(56) References Cited

U.S. PATENT DOCUMENTS

| | | | | |
|---|---|---|---|---|
| 6,005,945 | A | 12/1999 | Whitehouse | |
| 6,010,069 | A | 1/2000 | Debois | |
| 6,199,055 | B1 | 3/2001 | Kara et al. | |
| 6,208,980 | B1 | 3/2001 | Kara | |
| 6,249,777 | B1 | 6/2001 | Kara et al. | |
| 6,385,504 | B1 | 5/2002 | Pintsov et al. | |
| 6,430,543 | B1 | 8/2002 | Lee et al. | |
| 6,532,452 | B1 | 3/2003 | Pintsov et al. | |
| 6,834,273 | B1 | 12/2004 | Sansone et al. | |
| 6,853,990 | B1 | 2/2005 | Thiel | |
| 7,149,726 | B1 | 12/2006 | Lingle et al. | |
| 7,182,259 | B2 | 2/2007 | Lubow et al. | |
| 7,225,170 | B1 | 5/2007 | Ryan, Jr. | |
| 7,266,531 | B2 | 9/2007 | Pintsov et al. | |
| 7,337,152 | B1 | 2/2008 | Gawler | |
| 7,343,357 | B1 | 3/2008 | Kara | |
| 7,458,612 | B1 | 12/2008 | Bennett | |
| 7,509,291 | B2 | 3/2009 | McBride et al. | |
| 7,548,612 | B2 | 6/2009 | Weissman et al. | |
| 7,711,650 | B1 | 5/2010 | Kara | |
| 7,778,924 | B1 | 8/2010 | Ananda | |
| 7,784,090 | B2 | 8/2010 | Lord et al. | |
| 7,831,518 | B2 | 11/2010 | Montgomery et al. | |
| 7,831,524 | B2 | 11/2010 | Whitehouse | |
| 7,963,437 | B1 | 6/2011 | McBride et al. | |
| 8,100,324 | B1 | 1/2012 | Leon | |
| 8,204,835 | B1 | 6/2012 | Ogg | |
| 8,240,579 | B1 | 8/2012 | Bennett | |
| 8,626,673 | B1 | 1/2014 | Bennett | |
| 8,775,331 | B1 | 7/2014 | Tsuie et al. | |
| 2001/0020234 | A1 | 9/2001 | Shah et al. | |
| 2001/0022060 | A1 | 9/2001 | Robertson et al. | |
| 2002/0032668 | A1 | 3/2002 | Kohler et al. | |
| 2002/0032784 | A1 | 3/2002 | Darago et al. | |
| 2002/0052841 | A1 | 5/2002 | Guthrie et al. | |
| 2002/0073050 | A1 | 6/2002 | Gusler et al. | |
| 2002/0082935 | A1 | 6/2002 | Moore et al. | |
| 2002/0099652 | A1* | 7/2002 | Herzen et al. | 705/39 |
| 2002/0143431 | A1 | 10/2002 | Sansone | |
| 2003/0029914 | A1 | 2/2003 | Hortman et al. | |
| 2003/0037008 | A1 | 2/2003 | Raju et al. | |
| 2003/0080182 | A1 | 5/2003 | Gunther | |
| 2003/0101143 | A1 | 5/2003 | Montgomery et al. | |
| 2003/0101148 | A1 | 5/2003 | Montgomery et al. | |
| 2003/0138345 | A1 | 7/2003 | Schwabe | |
| 2003/0167241 | A1 | 9/2003 | Gilham | |
| 2003/0182155 | A1 | 9/2003 | Nitzan et al. | |
| 2003/0187666 | A1 | 10/2003 | Leon | |
| 2003/0204477 | A1 | 10/2003 | McNett | |
| 2003/0233276 | A1* | 12/2003 | Pearlman et al. | 705/14 |
| 2003/0236709 | A1 | 12/2003 | Hendra et al. | |
| 2004/0002926 | A1 | 1/2004 | Coffy et al. | |
| 2004/0048503 | A1 | 3/2004 | Mills et al. | |
| 2004/0064422 | A1 | 4/2004 | Leon | |
| 2004/0089482 | A1 | 5/2004 | Ramsden et al. | |
| 2004/0122776 | A1* | 6/2004 | Sansone | 705/402 |
| 2004/0128264 | A1* | 7/2004 | Leung et al. | 705/402 |
| 2004/0185827 | A1 | 9/2004 | Parks | |
| 2004/0185882 | A1 | 9/2004 | Gecht et al. | |
| 2004/0186811 | A1 | 9/2004 | Gullo et al. | |
| 2004/0215581 | A1 | 10/2004 | Lord et al. | |
| 2004/0215583 | A1 | 10/2004 | Elliott | |
| 2005/0065892 | A1 | 3/2005 | Ryan et al. | |
| 2005/0065896 | A1 | 3/2005 | Kummer et al. | |
| 2005/0065897 | A1 | 3/2005 | Ryan et al. | |
| 2005/0080751 | A1 | 4/2005 | Burningham | |
| 2005/0116047 | A1 | 6/2005 | Lu et al. | |
| 2005/0119786 | A1* | 6/2005 | Kadaba | 700/224 |
| 2005/0171869 | A1 | 8/2005 | Minnocci | |
| 2005/0192899 | A1 | 9/2005 | Reardon | |
| 2005/0237203 | A1 | 10/2005 | Burman et al. | |
| 2005/0278266 | A1* | 12/2005 | Ogg et al. | 705/408 |
| 2006/0000648 | A1 | 1/2006 | Galtier | |
| 2006/0020505 | A1 | 1/2006 | Whitehouse | |
| 2006/0122947 | A1 | 6/2006 | Poulin | |
| 2006/0173796 | A1 | 8/2006 | Kara | |
| 2006/0220298 | A1 | 10/2006 | Fairweather et al. | |
| 2006/0259390 | A1 | 11/2006 | Rosenberger | |
| 2006/0283943 | A1 | 12/2006 | Ostrowski et al. | |
| 2007/0033110 | A1 | 2/2007 | Philipp et al. | |
| 2007/0073587 | A1 | 3/2007 | Walker et al. | |
| 2007/0078795 | A1 | 4/2007 | Chatte | |
| 2007/0080228 | A1 | 4/2007 | Knowles et al. | |
| 2007/0174215 | A1 | 7/2007 | Morel | |
| 2007/0255664 | A1 | 11/2007 | Blumberg et al. | |
| 2009/0164392 | A1 | 6/2009 | Raju et al. | |
| 2010/0298662 | A1 | 11/2010 | Yu et al. | |
| 2010/0312627 | A1 | 12/2010 | Khechef et al. | |
| 2011/0015935 | A1 | 1/2011 | Montgomery et al. | |
| 2011/0022544 | A1 | 1/2011 | Kim et al. | |
| 2011/0029429 | A1 | 2/2011 | Whitehouse | |
| 2011/0071944 | A1 | 3/2011 | Heiden et al. | |
| 2011/0145107 | A1 | 6/2011 | Greco | |
| 2011/0225180 | A1 | 9/2011 | Liao et al. | |
| 2012/0008766 | A1 | 1/2012 | Robertson et al. | |
| 2012/0159603 | A1 | 6/2012 | Queck | |
| 2012/0233252 | A1 | 9/2012 | Vats et al. | |
| 2012/0240204 | A1 | 9/2012 | Bhatnagar et al. | |

FOREIGN PATENT DOCUMENTS

| | | | |
|---|---|---|---|
| WO | WO-02063517 | A2 | 8/2002 |
| WO | WO-03/039051 | A2 | 5/2003 |
| WO | WO-03/083784 | | 9/2003 |

OTHER PUBLICATIONS

Anonymous, "Automated Indicia Detection System From Parascript Protects Postage Revenue for Postal Operators, Cracks Down on Fraud:—Parascript StampVerify Simplifies Complex Task of Automatically Locating and Verifying Different Types of Indicia on Envelope Images—," PR Newswire, New York, Sep. 18, 2007.*

Alexander, Keith L., "U.S. Stamps Pay Tribute to Starry-Eyed Jurors", Final Edition, Calgary Herald, Calgary, Alberta, Canada, Sep. 14, 2007, 2 pgs.

U.S. Appl. No. 10/862,058, Pagel et al.

U.S. Appl. No. 11/509,309, J. P. Leon.

U.S. Appl. No. 11/729,148, Stamps.com.

U.S. Appl. No. 12/030,739, McBride et al.

U.S. Appl. No. 11/616,546, Bussell et al.

Office Action issued for U.S. Appl. No. 11/353,690 dated Aug. 3, 2009, 19 pgs.

"Mobile Postage stamps via text message announced", http://telecoms.cytalk.com/2011/03/mobile-postage-stamps-via-text-messages-announced/, CY.TALK Telecoms News Blog, Mar. 14, 2011 in Telecoms, Texting, pp. 1-9.

Mobile Postage Stamps Via Text Messages Announced, Phone Reviews, Mobile Phones, News, Mar. 11, 2011, pp. 1-3.

"Domestic Mail Manual Section 604", Aug. 31, 2005.

* cited by examiner

Activation Success file:///S:/Product/Public/PC Postage/Prototype/Activation_Success.html...

Your activation is complete. See below for details and further actions:

| Activated Transactions | | |
|---|---|---|
| # Transactions | Total | Actions |
| 287 | $349.04 | SCAN Form / Carrier Pickup / SCAN & Pickup |

| Transactions Not Activated | | |
|---|---|---|
| # Transactions | Total | Note |
| 46 | $73.19 | IMPORTANT: Please do not submit these to the Post Office |

Done

Done | NO CP

*FIG. 10B*

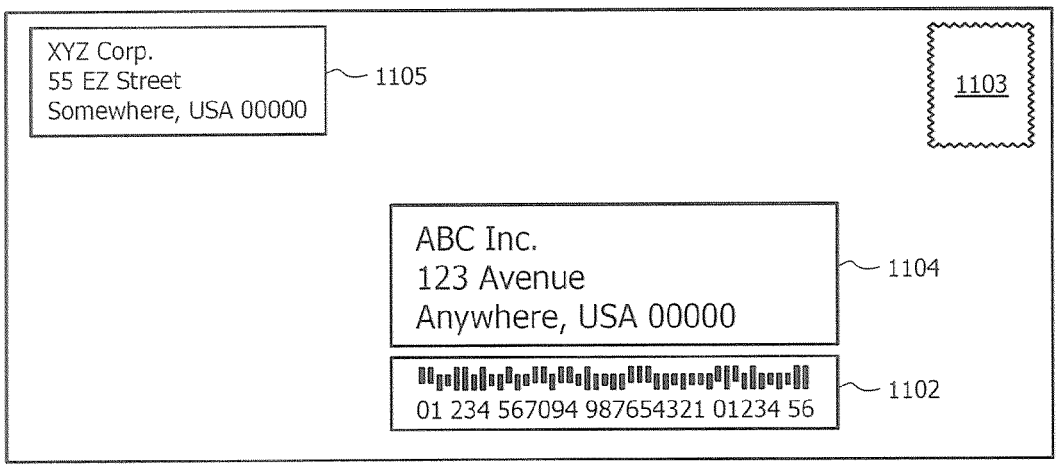

*FIG. 11*

SYSTEMS AND METHODS FOR PAYMENT OF POSTAGE INDICIA AFTER THE POINT OF GENERATION

CROSS-REFERENCE TO RELATED APPLICATIONS

The present application is a continuation in part of commonly assigned U.S. patent application Ser. No. 12/103,496 entitled "Systems and Methods for Activation of Postage Indicia at Point of Sale," filed Apr. 15, 2008 and is related to co-pending and commonly assigned U.S. patent application Ser. No. 10/862,058 entitled "Virtual Security Device," filed Jun. 4, 2004 and published as 2005/0256811 on Nov. 17, 2005; Ser. No. 10/991,241 entitled "System and Method for Generating Postage Indicia," filed Nov. 17, 2004 and published as 2005/0071297 on Mar. 31, 2005; Ser. No. 11/616,569 entitled "Postage Metering with Accumulated Postage," filed Dec. 27, 2006; Ser. No. 11/713,533 entitled "System and Method for Printing Multiple Postage Indicia," filed Mar. 2, 2007 and published as 2007/0198441 on Aug. 23, 2007; Ser. No. 11/509,309 entitled "Invisible Fluorescent Ink Mark," filed Aug. 24, 2006; Ser. No. 11/729,148 entitled "Computer-Based Value-Bearing Item Customization Security," filed Mar. 27, 2007; Ser. No. 12/030,739 entitled "Systems and Methods for the Distributed Activation of Postage," filed Feb. 13, 2008; and Ser. No. 12/103,483 entitled "Systems and Methods for Distributed Printing of Postage Indicia," filed Apr. 15, 2008.

TECHNICAL FIELD

The present invention relates to postage indicia and, more particularly, to providing payment for, or otherwise being liable for, postage indicia at a selected time after generation.

BACKGROUND OF THE INVENTION

The use of postage indicia in place of traditional postage stamps has become widespread. For example, solutions for generating and printing valid postage indicia using a home or office processor-based system, such as a personal computer, have been provided by Stamps.com Inc., Los Angeles, Calif. (the assignee of the present application) for a number of years.

Such solutions have facilitated ad hoc generation and printing of postage indicia, such as to generate and print individual postage indicia for a particular mail item. For example, during or upon completion of a letter or other document in a word processing application, such as WORD available from Microsoft Corporation, Redmond, Wash., a user may utilize client software provided by Stamps.com Inc. to generate and print valid postage indicia for use in posting that document, and the generated indicia may include information linking the postage indicia to that document.

The foregoing solutions have additionally facilitated batch generating and printing of postage indicia, such as to generate and print plural postage indicia for later use with various mail items. For example, a user may utilize client software provided by Stamps.com Inc. to generate and print a sheet of "generic" postage indicia for use with mail items similar to how a more traditional sheet of stamps may be used. Such generic postage indicia are not linked to a particular mail item; thus, the indicia would not include information linking the postage indicia to the mail item. Such indicia may, however, include information identifying the user creating the postage indicia, the user's account used in creating the postage indicia, etc.

In these traditional on-demand postage systems, customers are traditionally required to buy postage value and keep a meter balance before they can generate and print postage. As indicia data is generated (e.g., by a postage server in an Internet based system), the postage value is immediately deducted from their balance. Thus, customers are charged for the indicia postage value before the indicia is printed.

Although providing a convenient solution for offering valid postage indicia to individuals and businesses upon demand, 24 hours a day, 7 days a week, the foregoing solutions may not address every situation. For instance, a mail item shipper may need to print many indicia over the course of a day but not want to pay for the postage value of the indicia at the time of printing. For example, in order to increase shipping efficiency, shippers often pack and prepare mail items (for example purchased merchandise) for shipment throughout the day. However, affixing postage indicia to a package which may never be shipped, assuming payment confirmation for the merchandise is not received, could be costly. Postage indicia comprise monetary value; thus, if the box bearing the indicia is discarded, the monetary value of the indicia is likewise discarded. The shipper may attempt to salvage the indicia by removing the indicia and placing it on another package; however, if the shipper is printing the type of indicia that comprises information about its associated mail item, as explained above, the indicia may not be used with a different package because the indicia information and the different package information will not match up. Accordingly, because the indicia may not be transferable to a different package, the postage value is lost. Further still, even if the shipper utilizes the generically printed indicia described above (e.g. indicia not linked to a particular package), attempts to remove an indicia from a package may cause irreparable damage to the indicia such that the indicia cannot be used after removal. Again, the postage value would be lost. Moreover, the time necessary to track and remove postage indicia from packages could offset any time or money saved by fully preparing the packages before payment confirmations were received. Thus, a solution is desirable that allows a shipper to fully prepare shipments throughout the day, including affixing valid postage indicia, while avoiding the loss of postage value for unshipped packages.

Similarly, a user sending several letters and/or packages a day must pay for an appreciable amount of postage value, and it is desirable for a user to control when and if he is charged for postage indicia. For example, a shippers that fill orders (e.g. an online retailer) may need to ship several packages to the same recipient. Often, the boxes will be packaged at different times but need to be shipped together. Thus, the shipper may want to prepare complete packages (including attached postage indicia) as they go but may not want to pay for the postage indicia until all the boxes are ready to be shipped.

Furthermore, many shippers ship a large number of packages a day and may need to purchase hundreds or thousands of dollars of postage in a month. Traditionally, as explained above, the shipper would need to maintain a balance in a postage account to cover the cost for postage. Thus, if the shipper anticipates needing between $50,000 and $150,000 worth of postage, the shipper would need to maintain a balance of at least that much postage in his account to ensure he can print the needed postage. Thus, a method is desirable that obviates the need to tie up appreciable sums of money in a postage account in anticipation of possible shipment orders.

Moreover, a mail item mailer may need to purchase postage indicia while away from his indicia printing system (e.g. while traveling). The mailer may wish to send a postcard which requires less postage value than traditional first class one ounce stamps or may want to send a package weighing more than one ounce and therefore requires more postage value than a traditional first class stamp. Typically, only a particular denomination of postage stamp (e.g., stamps valued for one ounce first class postage, which today is $0.44) is available at most points of sale, such as retail locations outside of a postal facility. Moreover, retail locations often do not carry a deep stock of postage in order to avoid having appreciable monies tied up in an item usually provided for patron convenience and which runs a risk of becoming stale with a change in postal rates. Accordingly, if postage is available at all at a point of sale, it is often not available in an exact denomination desired by a user. Thus, it would be desirable for a system to provide for the sale of printed tokens which could be assigned any postage value at the point of sale so that a retailer could offer indicia carrying any amount of postage value and is relieved from tying up money in postage indicia.

The shipments discussed above involve delivery entities that require the use of postage indicia as proof of payment for postal services such as the United States Parcel Service (USPS). Other delivery entities, for example United Postal Service of America, Inc. (UPS) and FedEx Corporation (FedEx), operate in a different manner. When using one of these distinct delivery entities, package shippers print shipping labels that include no postage indicia and therefore carry no postage value. When preparing shipping labels, the shippers go to a processing screen, where they "close" their shipments and prepare any forms necessary. This step confirms which packages they are shipping and may be used later to create a customer bill when the customer's balance becomes due. When creating a customer's bill, the customer is not charged for shipping labels because shipping labels hold no monetary value. Rather, the delivery service charges the user for shipping services actually rendered. Therefore, users often print a particular label multiple times to keep track of services rendered and for accounting purposes (e.g. filing the label away for the user's records, sending the label to accounting for reimbursement, compiling the labels to compare against future bills received, etc.).

These valueless shipping labels are distinct from postage indicia and labels comprising postage indicia, because with postage indicia, the customer is purchasing and paying for the indicia itself (or the label comprising the postage indicia). Furthermore, the indicia itself comprises monetary value. Accordingly, the postage indicia itself has value (i.e. postage value) such that the user is charged for the postage indicia (or the label comprising postage indicia) whether or not the user mails a mail item. Thus, because each indicia holds value, to prevent fraud, users are traditionally prevented from printing multiple copies of a particular indicium. Furthermore, because each indicia holds value, the loss, destruction, or theft of a postage indicium results in the loss of monetary value.

BRIEF SUMMARY OF THE INVENTION

The present invention is directed to systems and methods which provide for generation and printing of tokens that are not yet activated (therefore not yet comprising postage value) and that are later activated and thereby converted from an unactivated token into an activated, value comprising postage indicium. The activation of postage indicia can occur at a selected time after the token is generated/created. According to embodiments of the invention, the user can select the exact moment the activation occurs, the delivery service provider can select the moment activation occurs, or the postage service provider can select the exact moment activation occurs, or some other entity can select the moment of activation. Therefore, because the user is not charged for the postage value until the token is converted into postage indicia via activation, in one selected embodiment, the user is in control of when he is charged for, or otherwise becomes liable for (e.g., in a post-payment system), the value of postage indicia. Note that tokens are unactivated and valueless and therefore cannot be used to validly mail a mail item. In contrast, indicia are "live" postage comprising postage value and can be used to validly mail a mail item. Also, note that the term postal items refer to mailing items and/or shipping items and tokens (or their postage indicia counterpart) may be applied to either mailing items and/or shipping items (e.g. letters, envelops, postcards, boxes, tubes, crates, ect.).

In embodiments of the invention, a printed token preferably includes some form of substantially unique identification information, such as a serial number, delivery confirmation number, signature confirmation number, digital signature, cryptographic code, etc., which substantially uniquely identifies the token and could identify an account associated with that token, wherein the account could comprise monetary value. According to a preferred embodiment, the token could include the identification information in a machine readable format, such as barcode (e.g. Information Based Indicia (IBI), magnetic ink character recognition (MICR) code, radio frequency identification (RFID) tag, holographic code, etc., so as to facilitate automated scanning of the information, such as by a scanner or other activation device.

In embodiments of the invention, a substantially unique number, such as a delivery confirmation number (or an Intelligent Mail Barcode), can be generated and associated with a mail item (and/or a token). Delivery service providers (e.g. USPS) often use delivery confirmation numbers to track mail items and confirm mail item deliveries. The delivery confirmation number can be printed as a human readable number or a machine readable barcode and is printed in a separate location on a label or mail item than the token is printed. For example, a delivery confirmation barcode could be printed below the address information. Because the delivery confirmation number is substantially unique, it can also be used by a postage service provider or a shipper to track a mail item, confirm the delivery of the mail item, activate a token, and more as disclosed herein.

Note that substantially unique means that the information is unique in normal use. For example, after a period of time (e.g. days, months, or years), the information may repeat. Alternatively, the information may repeat after a certain amount of different number combinations have been used. Accordingly, a user may be confident that the information will identify only one piece of mail at a given time.

At some point after generation, selected tokens are preferably activated, to thereby become live postage indicia. For example, the token's substantially unique identification may be identified to the system using an activation means (e.g., using a graphic user interface (GUI), a scanner, a MICR reader, an RFID scanner, optical character recognition (OCR) system, etc.). The identification information, preferably accompanied by additional information (e.g., desired number of postage indicia, postage value amount, postage class, account for payment of postage value, etc.) may be provided to an entity for assigning or activating the tokens as live postage. For example, the foregoing information may be provided to the postage service provider which was involved in the initial creation of the tokens.

In operation according to embodiments of the invention, the identification information may be used to assign or activate tokens, and thus, convert the token into a valid postage indicia acceptable to a postal authority. For example, copies of the tokens, information included within the tokens, information identifying the tokens, etc. may be moved from a token database to an indicia database to activate the tokens into postage indicia. Other information may additionally or alternatively be stored in association with activated tokens, such as user information (e.g., user identification, payment information, etc.), activator information (e.g., activation device identification, activation location, etc.), point of sale, and/or the like.

Activation of the postage indicia preferably includes payment to a postal authority (e.g., the USPS) for the appropriate postage value, such as through decrementing a descending register of a postage security device, debiting a prepaid account, incrementing a postpaid account, or otherwise making a user liable for the postage value. Upon activation, the delivery service provider may receive payment from the postage service provider for the activated token, wherein the shipper is charged, or otherwise made liable by the postage provider for the activated token. The foregoing payment for postage value may be provided directly from a user, indirectly from a user through an activation service provider (e.g., retailer), indirectly from a user through a postage service provider (e.g., Internet postage provider), directly from an activation service provider, indirectly from an activation service provider through a postage service provider, etc.

According to embodiments of the invention, a generated token can be activated (converted into a value comprising postage indicia) at a selected time after generation. It is only at the point of activation that the user is charged for, or otherwise liable for, the postage value of the indicia. For example, the token may be activated moments after generation, at the end of the day of generation, weeks or years after generation, at the moment the token is given to the delivery carrier, at some point within the delivery stream, just prior to handing the mail item to the recipient, or at the time of token purchase (e.g. at a point of sale such as a vending machine or convenience store's cash register). Moreover, the token may be activated by any number of people. The shipper may activate the token himself. Alternatively, an agent of the delivery service provider may activate the token while the mail item is in the mail stream. In other embodiments, the token may be activated by a scanner installed in a mail box whereby the token is activated as the shipper drops the mail item into the mail box. Further still, the token may be activated by an entity selling the token to a shipper. For example, if the token is generated by a token vender (such as a convenience store), the token may be activated by the vendor when the token is sold by the vender to the shipper. Any number of people may activate the token at various points in the mailing process because the invention is directed at the generation and printing of unactivated tokens which are activated into postage indicia at some time thereafter.

For example, a user may print one unactivated token or several unactivated tokens throughout a day using client software or web based software and a printer. The printed tokens may look like postage indicia in that they may include features traditional to postage indicia such as an Information Based Indicia (IBI) barcode (note however, that the until the token is activated, the IBI within the token is likewise not activated). Likewise, rather than being full IBI, the token may be an unactivated IBI Lite as described in "MAIL PIECE PROCESSING," application Ser. No. 12/316,542 filed on Dec. 11, 2008 and incorporated herein by reference. However, it is important to understand even though the token may appear to be similar or even identical to a postage indicia, the token does not become an indicia until the token is activated. At some point after printing the token, the user may choose to activate some or all of the printed tokens. When the user is ready to be charged for postage value, the user may activate selected tokens by using a graphic user interface (GUI) provided by client software or a web browser that includes an activation option allowing selective activation of the particular tokens the user wishes to activate. Once the activation option is chosen, the selected tokens are activated and therefore become indicia. At this point, the user is made liable for those selected indicia which the user chose to activate. The unselected tokens remain tokens because they have not yet been activated. Further, the GUI could offer a void option, whereby the user voids selected tokens he wishes to be voided. The user is not charged postage value for those selectively voided tokens, nor is the user charged for tokens he has not yet activated.

Additionally or alternatively, the client software or web browser is able to create an end of day list listing printed tokens. At the end of the day (hour, week, or other selected time frame), all tokens which were not selectively voided by the user could automatically be activated into indicia by the system, and thus, the user would, at that time, be made liable for the postage value. Alternatively, the system could be configured such that at the end of the designated time period, any printed token which was not activated is automatically voided, and at that time, the user is only liable for tokens which the user indicated to the system he wished to be activated.

In other embodiments, the user is able to use a printed SCAN form ("SCAN forms" are a particular form which may be required by the USPS) or manifest (SCAN form and manifest are collectively referred to as "form") to selectively activate tokens. A form comprises a list which identifies generated/printed tokens. In embodiments of the invention, each token could be individually identified by substantially unique information and/or by a barcode listed on the form wherein each barcode represents a individual token. The barcode may be the mail item's delivery confirmation number or a barcode, which was generated specifically for the form. Additionally or alternatively, the form may include a single barcode (e.g., a "form barcode" for example, at the top of the form) that identifies every listed token. Of course, the form may be configured in any number of ways for example by group barcodes, which are barcodes organizing the tokens into user specified groups, service provider specified groups, destination groups, etc. At activation time, the user could selectively activate some or all of the tokens by scanning with a scanner (or otherwise inputting into an activation device) each token's individual barcode. Alternatively, if the form includes a "form barcode" identifying every token listed on the form, the user could activate all of the listed tokens at once by scanning (or otherwise inputting into an activation device) the form barcode's information. Further still, if the form includes "group barcodes," the user could activate the tokens identified within a group barcode by scanning (or otherwise inputting into an activation device) the group barcode information. Once tokens (or a single token) are scanned, the tokens are activated, become postage indicia, and the user is made liable for the postage value.

Alternatively, because each individual printed token may include IBI (albeit unactivated IBI) or other machine understandable information, the user is able to activate the token by scanning the token itself. Once the token is scanned (or otherwise identified to the activation device), the token is activated, becomes postage indicium, and the user is made liable for the postage value.

Other embodiments of the present invention are directed to systems and methods allowing a mailer to place mail items or packages marked with an unactivated token into the delivery stream. According to embodiments of the invention, the unactivated token can be activated and therefore converted into postage indicia at some point in the delivery stream (i.e. at some point at or after mailing but before delivery of the mail item). For example, the user may print the token, and if desired, a delivery confirmation number, himself using client software or web a web interface, affix the token to a mail item, and drop the mail item at the post office. At this point, the mail item is in the delivery stream because the mailer released control of the mail item to the delivery service provider (in this case the USPS). Further, because the mail item comprises a token, not a postage indicia, the mailer has not yet been made liable for postage value. According to embodiments of the invention the token can be activated after mailing; thus, the postal worker who accepts the mail item could scan the unactivated token to activate the indicia. The sorter (whether it be a person or machine) could scan the token thereby activating the indicia. The token may be activated by a pilot (if the mail item were flown to its location) or a truck driver (if the item were driven to its destination city). The token may be activated by the delivery agent just as he is placing the mail item into the recipient's mail box or into the recipient's hands. The token could be activated by inputting token information and/or delivery confirmation number information into a GUI displayed on a computer, laptop, remote device, PDA, etc. located in a post office, delivery rendezvous point, a delivery truck, a delivery plane, a mail truck, or any other location along the delivery stream. The token could be activated by a scanner used to scan information in the token and/or information in the delivery confirmation number (e.g. a barcode scanner, OCR scanner, RFID reader). Accordingly, the user could be made liable for the postage value days after placing the mail item or package into the delivery stream. For example, the user may not be made liable for postage value until the mail man received a delivery confirmation signature for the mail item.

Other embodiments of the present invention facilitate activation of postage indicia at various point of sale locations, such as retail locations, consumer kiosks, vending machines, etc. Embodiments implement techniques to avoid widespread availability of live/activated postage indicia and/or prevent printing of fraudulent postage indicia.

Tokens sold by venders, or otherwise provided according to embodiments of the invention, may have a preestablished postage denomination associated therewith (e.g., $0.44) or may be denomination agnostic. A postage value for denomination agnostic tokens may be assigned upon activation as postage indicia, such as in accordance with an amount tendered for postage value at the point of sale or in accordance with a proper amount of postage for the mail item to which the token has been attached. It should be appreciated, however, that even where tokens have a preestablished postage denomination associated therewith, the token itself has no value according to embodiments of the invention. That is, the preestablished postage denomination of embodiments establishes an amount of value that is to be afforded to a postage indicium resulting from activation of the token according to embodiments of the invention.

Postage indicia activated according to embodiments of the invention may comprise centrally printed tokens which are distributed to various locations (e.g. points of sale, shipping warehouses, user's homes, etc.) for activation as postage indicia according to the present invention. For example, a manufacturer, such as a postage service provider (e.g., a PC postage vendor, an Internet postage vendor) or a postal authority (e.g., USPS or other indicia requiring postal services), may provide centralized printing of tokens on postage stock. Alternatively or additionally, the tokens may be printed at the various locations. For example, points of sale (e.g. a retail location, such as a discount store, department store, convenience store, drug store, etc.), shipping warehouses, user's homes, mail rooms at businesses, etc., may periodically interact with a postage service provider or postal authority to print a supply of tokens.

In embodiments of the invention, a shipper can be limited to the number of tokens that can be activated at one time. The limit could be based on a number selected by the shipper and/or by the postage service provider. The limit could be based on the postage amount printed. For example, the shipper could be limited such that he can only print an amount of unactivated tokens representing a total postage amount which does not surpass the amount of credit in the user's account. The limit could be placed on the activation rather than the printing. For example, a shipper may be allowed to print any number of tokens but limited to only activating postage amounts up to the amount of credit the shipper has in his account. Thus, in one example, a shipper with $50 of credit in his account could generate and print tokens representing hundreds of dollars but only is allowed to activate $50 worth of tokens. Of course, if the user in this example increased his account credit, then the user could activate more tokens up to that amount. Alternatively, there may be no limit on the postage amount or number of tokens printed, or various limits could be placed on some shippers but not others.

Tokens, as may be printed on postage stock according to embodiments of the invention, may comprise complete or partial tokens. For example, where tokens are provided in the form of unactivated IBI barcodes, a partial unactivated IBI barcode may be printed within each portion of the postage stock which is to later form a postage indicium. Such incomplete tokens are preferably completed at a later time, such as during activation, adding further security with respect to preventing fraudulent or unauthorized use of tokens used in creating valid postage indicia. However, even where the token printed on the postage stock is a complete token, its being unassigned or unactivated provides security with respect to preventing fraudulent or unauthorized use of the token.

Accordingly, the postage stock, having tokens printed thereon, may be distributed to various locations for use in creating valid postage indicia according to embodiments of the invention with little or no risk that the tokens thereon can be fraudulently used. For example, postage stock bearing tokens according to embodiments of the present invention may be placed on retail shelves for purchase at various retail locations without substantial risk that such tokens may be stolen because the tokens only have value upon activation according to embodiments of the invention. The postage stock bearing such tokens may be selected for purchase by an individual and postage indicia activated at the point of sale using a substantially traditional payment model (e.g., payment by a purchaser to a retail merchant by cash, check, credit card, debit card, etc.). Once the retailer receives payment for the token, the retail could then activate the indicia according to embodiments of the invention such that the token is converted into a valid postage indicia.

In another example, postage stock bearing tokens according to embodiments of the present invention may be distributed to shipping warehouses without substantial risk that the tokens will be stolen by employees or trespassers because tokens only have value upon activation according to embodiments of the invention. The postage stock bearing the tokens may be selected for activation by an authorized employee of the shipping warehouse, and once activated according to embodiments of the invention, can be used to ship packages.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which:

FIGS. 10A and 10B depict examples of graphical user interface screens that are presented to a user during the operation of embodiments of the invention; and FIG. 11 depicts an example of a mail item with a token attached thereto.

DETAILED DESCRIPTION

Figure 1A:
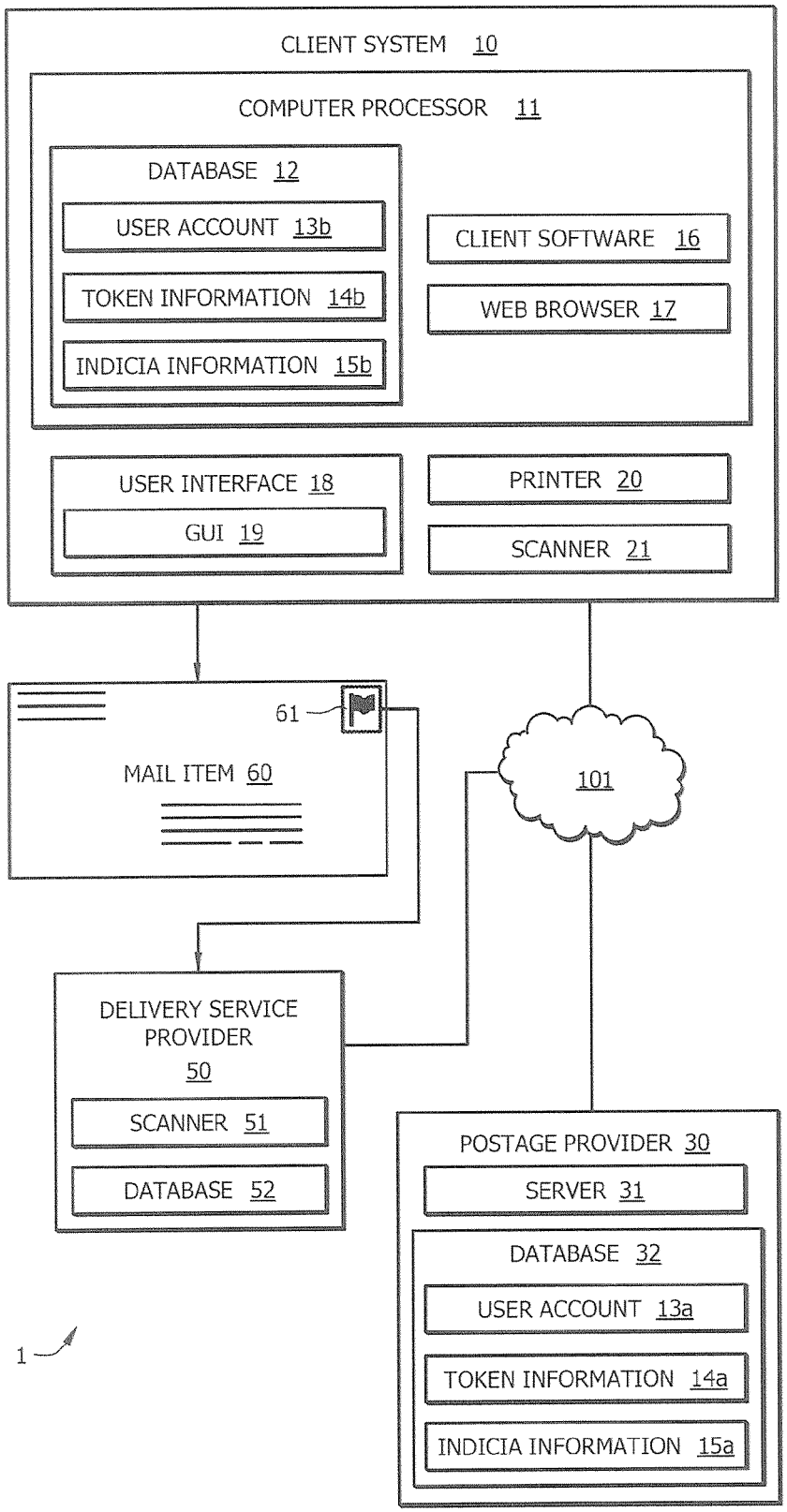
FIG. 1A shows a system adapted to provide activation of postage indicia at a point after generation of tokens.

Embodiments of the invention are directed at the creation and printing of tokens which can be converted into postage indicia at a time after their generation. Because a user is not charged for, or otherwise made liable for, postage value until the token is activated, embodiments of the systems and methods described allow a user to create tokens without paying for postage value. At a time or a point thereafter, the token can be activated if desired, at which point the user will be charged, or otherwise become liable for, the postage value. If a given token is voided or never activated, the user is never made liable for the postage value. Various systems and methods of activation are taught herein and various combinations of the methods and systems described herein could be used to activate the tokens into value bearing postage indicia.

Directing attention to FIG. 1A, system 1 is shown generating tokens (which include no postage value and are therefore invalid for mailing mail items), which may later be activated into postage indicia. Client system 10 comprises computer processor 11, embodiments of which are described in more detail below with regards to activation system 110 of FIGS. 1B and 1C, may be any computer processor configured to provide functionality as described herein. Computer processor 11 is in communication with postage provider 30 via communications network 101. Operable on computer processor 11 is client software 16 and/or web browser 17. Client software 16 and/or web browser 17 are operable to receive generated tokens from postage provider 30 via network 101. Server 31 of postage provider 30 is operable to generate tokens and send the tokens to client system 10 via communications network 101.

Postage provider 30 may include database 32 including any or all of user account 13*a*, token information 14*a*, and/or indicia information 15*a*. In embodiments of the invention, user account 13*a* may be used to charge a user, or otherwise make liable, for activated indicia and may be used to create tokens. User account 13*a* may comprise a vault with ascending and descending registers, a prepaid account, a post-paid account, a credit card account, or any other means of making a user liable as described herein. Token information 14*a* may comprise information about generated tokens such as the token's substantially unique code, a delivery confirmation number, a signature confirmation number, date of generation, information regarding the user, recipient, delivery address, and/or any information pertaining to tokens as described herein. Indicia information 15*a* may comprise information about activated indicia including, but not limited to, the indicia's substantially unique code, a delivery confirmation number, a signature confirmation number, date of activation, information regarding the user, recipient, delivery address, and any other information pertaining to indicia as describe herein.

As shown in FIG. 1A, user account 13*a*, token information 14*a*, and/or indicia information 15*a* may be located in various places and/or multiple places within the system (e.g., postage provider database 32, client system database 12, remote database 40, and/or delivery service provider 50). Further, user account 13 could be located together or separate from token information 14 which may be located either together or separate from indicia information 15. The location of the various user accounts 13, token information 14, and/or indicia information 15 is not germane to operation of the system because network 101 allows for information exchange among the various components of the system. Further, duplications of any of user account 13, token information 14, and/or indicia information 15 could be located at the various shown system locations.

Upon generation of a token, information about the generated token may be stored in token information 14. To activate a token, some or all information associated with that activated token may be copied from or moved from token information 14 to indicia information 15. Of course, additional information regarding the activated indicia may be stored in indicia information 15. Alternatively, database 12 (or postage provider database 32, remote database 40, and/or delivery service provider 50) may combine user account 13*b*, token information 14*b*, and/or indicia information 15*b* such that a single database (not shown) stores information about tokens and for activating tokens. For example, the generated token information could be stored in the database with a status of "unassigned" or "unactivated." Then, to activate the token, the status stored in the database could be changed to "unassigned" or "activated."

Additionally or alternatively, client software 16 and/or web browser 17 are operable to generate tokens. Upon generation, information regarding the token is stored in token information 14, and upon activation, information about the indicia and its activation is stored in indicia information 15.

Client system 10 also includes user interface 18 (e.g., GUI 19). User interface 18 may be used in the generation of tokens and/or the receiving of generated tokens and the printing of generated tokens. Once a token is generated, the user can use user interface 18 to indicate to printer 20 that the token should be printed. Printer 20 can print token 61. Token 61 can be printed directly on mail item 60 or can be printed on a transfer medium (e.g. a label) for later attachment to (or otherwise association with) mail item 60. Note that while mail item 60 appears to comprise a valid postage indicia, mail item 60 comprises a token which does not yet comprise postage value and is therefore not yet valid.

The printed token 61 can be activated at a selected time after generation by various entities as described herein. For example, as explained in detail below, the client may use GUI 19 or scanner 21 located at client system 10 to activate token 61. Alternatively, delivery service provider 50 could use scanner 51 (or a GUI not shown) to activate token 61. Likewise, a point of sale (not shown) could use a scanner, GUI, or other method disclosed herein to activate token 61. Once token 61 is converted into postage indicium, user account 13*a*, 13*b*, and/or 13*c* (wherever the account may be located as disclosed herein) is charged, or otherwise becomes liable for, the cost of the postage indicium, and the indicium is valid for mailing the mail piece.

Point of Sale Activation

Among the various methods and systems for activating tokens into indicia is point of sale activation. Directing attention to FIGS. 1B and 1C, systems adapted to provide activation of postage indicia at a point of sale according to embodiments of the invention are shown as system 100. System 100 of the illustrated embodiments comprises activation system 110, point of sale system 120, and validation system 130, in communication through network 101, cooperating to provide activation of postage indicia at a point of sale. It should be noted that various components of system 100 could also be utilized in other embodiments disclosed herein. For example, scanner 123, which is used herein to activate a token, can be located at a client's home or business and/or in a postal delivery truck and can be used to activate a token in various embodiment disclosed herein.

Network 101 of the illustrated embodiments provides information communication between activation system 110, point of sale system 120, and validation system 130. The foregoing systems may be disposed locally or remotely with respect to one another. For example, activation system 110 and validation system 130 may be disposed locally with respect to each other (e.g., at a postal system facility), whereas point of sale system 120 may be disposed remotely with respect to activation system 110 and validation system 130 (e.g., at a retail location or public space). Of course, activation system 110 and validation system 130 may be disposed remotely with respect to each other, if desired. Accordingly, network 101 of embodiments may comprise the Internet, an intranet, an extranet, a local area network (LAN), a metropolitan area network (MAN), a wide area network (WAN), the public switched telephone network (PSTN), a wireless network, a cable transmission system, a satellite communication network, and/or the like.

Activation system 110 preferably comprises a processor-based system, such as a computer having a central processing unit (CPU), memory (shown as including database 112), and appropriate input/output (I/O) devices and interfaces, operable under control of an instruction set defining operation as described herein. For example, activation system 110 may comprise server platform 111 having a processor from the PENTIUM family of processors available from Intel Corporation, Santa Clara, Calif. Activation system 110 of the illustrated embodiment provides generation, printing, and activation of tokens for use in generation and printing of postage indicia as described below. Accordingly, activation system 110 of the illustrated embodiments includes database 112 for storage of token identification and status (e.g., as may be provided in unassigned token database 114 and assigned token database 115) and printer 113 for printing tokens on postage stock, such as may comprise envelopes, labels, sheets of paper, etc.

Although shown as a single system for simplicity, activation system 110 of embodiments may be implemented as a plurality of platforms. For example, separate platforms may be used to generate and print tokens and/or to activate tokens. Printing of tokens separately from activating the postage indicia as postage indicia may be particularly useful in scenarios where envelope manufacturers or other stock manufacturers include tokens for postage indicia on various forms of envelopes and/or other stationary items at the time of manufacture wherein the retail shop that sells the envelopes and/or other stationary items activate the tokens thereon.

Point of sale system 120 preferably comprises a processor-based system, such as computers having a CPU, memory, and appropriate I/O devices and interfaces, operable under control of instruction sets defining operation as described herein. For example, point of sale system 120 may comprise a computer platform 121 having a processor from the PENTIUM family of processors available from Intel Corporation, Santa Clara, Calif. Point of sale system 120 preferably provides communication of postage stock and/or token identification information to activation system 110 for activation of tokens for use as postage indicia according to the concepts of the present invention. Accordingly, the illustrated embodiments of point of sale system 120 includes scanner device 123 for scanning postage stock identification information, tokens and/or other identification information (e.g., a delivery confirmation number and/or barcode, a signature confirmation number and/or barcode), as will be discussed in further detail below. Of course, other forms of input of information regarding the forgoing information may be utilized according to embodiments of the invention, such as a keyboard of point of sale (POS) terminal 124. For example, scale 129 is provided for input of postal item weight, such as for use in rating postage in order to determine an appropriate or desired amount of postage value for activated postage indicia.

Figure 1B:
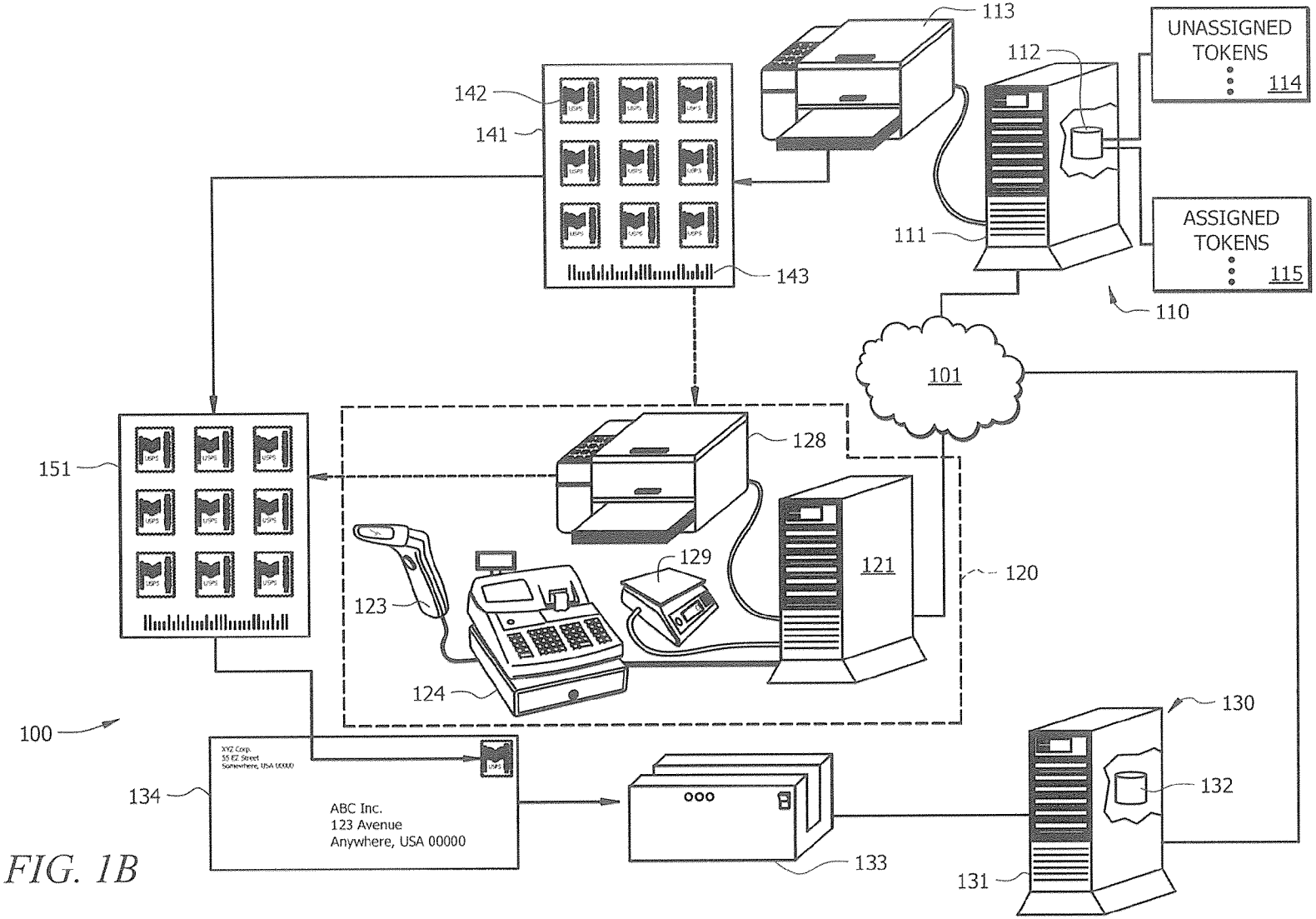
FIGS. 1B and 1C show systems adapted to provide activation of postage indicia at a point of sale according to an embodiment of the present invention.
Figure 1C:
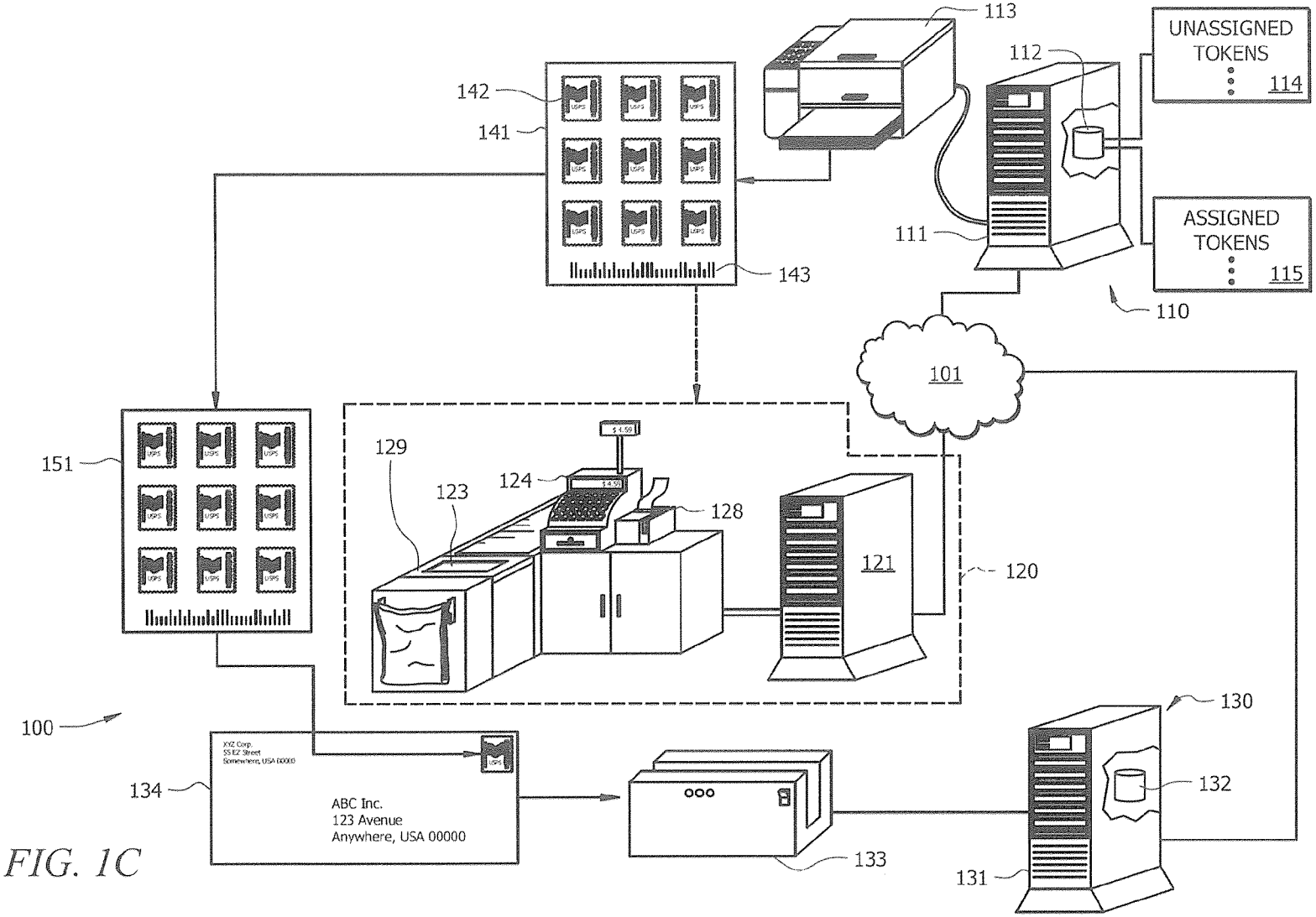

Although shown as separate components in the embodiment illustrated in FIG. 1B, it should be appreciated that point of sale system 120 may comprise different configurations than that shown. For example, scanner device 123 may be integrated into POS terminal 124 and/or POS terminal 124 may be integrated into computer platform 121. The embodiment illustrated in FIG. 1C, for example, comprises an integrated POS terminal configuration such as may be found in a grocery store checkout aisle. In the embodiment illustrated in FIG. 1C, scanner 123 comprises a laser scanner disposed in the checkout conveyer path of the checkout isle, such as is common with universal price code (UPC) scanners used by grocery stores. Similarly, scale 129 comprises a flatbed scale integrated with scanner 123, such as is common with produce scales used by grocery stores. POS terminal 124 may interface with scanner 123 and scale 129 to obtain information therefrom as described above. POS terminal 120 further interfaces with printer 128, such as is common with receipt and check endorsing printers used by grocery stores.

Validation system 130 is not limited to use with point of sale activation and can be integrated into various ones of the embodiments disclose herein; however, for simplicity, validation system is shown in FIG. 1B. Validation system 130 preferably comprises a processor-based system, such as a computer having a CPU, memory (shown as including database 132), and appropriate input/output (I/O) devices and interfaces, operable under control of an instruction set defining operation as described herein. For example, validation system 130 may comprise server platform 131 having a processor from the PENTIUM family of processors available from Intel Corporation, Santa Clara, Calif. Validation system 130 of the illustrated embodiments provides scanning and validation of postage indicia borne on mail pieces as described below. Accordingly, validation system 130 of the illustrated embodiments includes database 132 for storage of validation information (e.g., postage indicia identification and status) and mail piece scanner 133 for scanning and processing mail pieces or shipping items. Of course, mail piece scanner 133 could be configured such that it scans packages of varying size and thickness.

It should be appreciated that configurations of validation system 130 other than that illustrated may be utilized according to embodiments of the invention. For example, mail piece scanner 133 may be coupled to activation system 110, such as through network 101, for performing validation as described herein without server platform 131, if desired.

Use of a validation system, such as validation system 130, is optional according to embodiments of the invention. However, to provide increased confidence as to the validity of postage indicia, and other information based indicia, embodiments of the invention implement a validation system. In order to reduce the volume of processing associated with such a validation system, embodiments of the invention may operate to validate a random or statistical sampling of indicia, rather than each indicia introduced into the mail stream.

Figure 2:
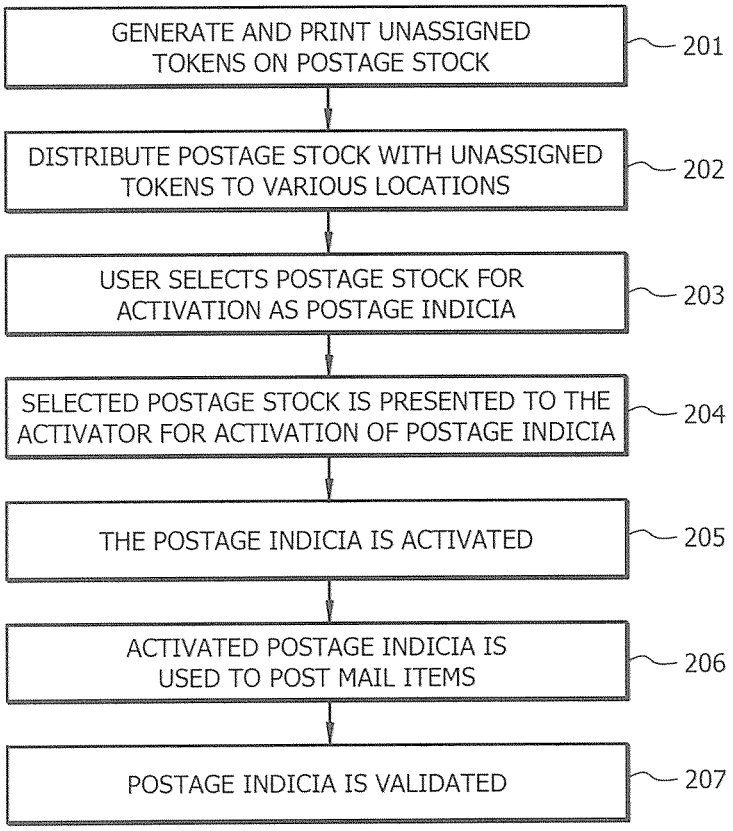
FIG. 2 shows a flow diagram of one of many operations to provide activation of postage indicia according to an embodiment of the present invention.

Operation of system 1 and system 100 to activate postage indicia according to an embodiment of the present invention is represented in the flow diagram of FIG. 2. According to the illustrated embodiment, a manufacturer (e.g., a postage service provider such as Stamps.com, Inc.) generates tokens for later activation into postage indicia, block 201. If desired, the postage service provider (also referred to herein as the token provider) can also generate delivery confirmation numbers associated with a particular generated token, wherein the delivery confirmation number is associated the token will both be attached to a mail item. The tokens (and if desired the delivery confirmation number) can be printed on postage stock. For example, client system 10 or activation system 110 generates a plurality of tokens and controls printer 20 or printer 113 to print tokens upon various postage stock, such as envelopes, labels, sheets of paper, etc. Each such token is preferably substantially unique so as to facilitate accurate activation, validation, accounting, and/or auditing with respect to the activation and use thereof.

Printers 20 and 113 of the illustrated embodiment print machine readable tokens 61 and 142 on postage stock 141. Although label stock having a plurality of postage indicia transfer areas thereon is illustrated as postage stock 141, embodiments of the invention may utilize different forms of stock. For example, envelope stock, plain paper stock, letterhead stock, label stock, large envelope (flat) stock, and combinations thereof may be utilized according to embodiments of the invention.

Figure 3A:
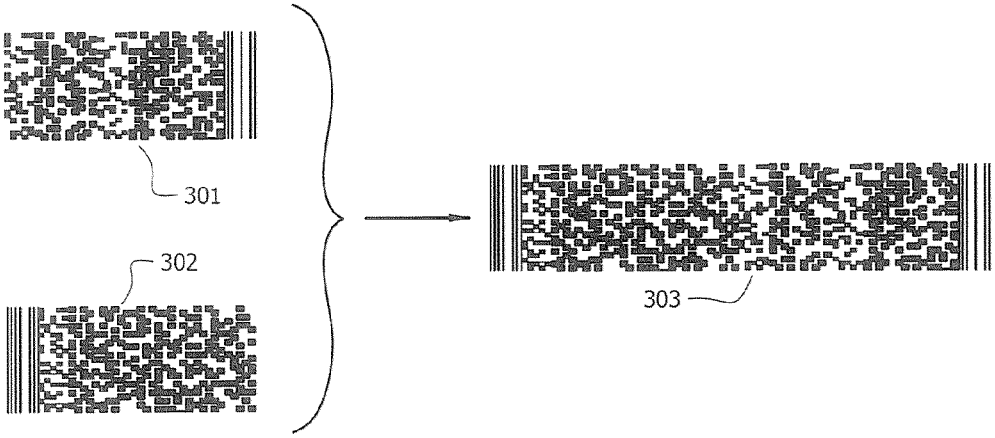
FIGS. 3A and 3B show various embodiments of partial tokens as may be completed according to embodiments of the invention.

Embodiments of the invention operate to print a complete token or a partial token on postage stock 141. For example, to provide added security with respect to misuse of the tokens, embodiments may operate to print a fractional token (e.g., partial token 301 of FIG. 3A) which is missing a portion thereof, such as a right, left, top, or bottom portion thereof (e.g., completion partial token 302). Such an embodiment may provide a token which is visibly incomplete, thereby rendering the token obviously unacceptable for use as postage indicia in its present state. Embodiments may additionally or alternatively operate to print apparently complete tokens (e.g., partial token 311), but which are missing one or more pieces of information, such as missing various "dots" of a two dimensional barcode (e.g., completion partial token 312), thereby rendering the token unacceptable for use as postage indicia, although perhaps not visibly so. The missing portions of such tokens are preferably stored, such as within database 12 (e.g., within token information 14) for later adding to the tokens. For example, when such a partial token is assigned or activated, the missing portion of the token may be provided for completing the token. The foregoing partial tokens may be completed by printing the completion partial token (e.g., completion partial tokens 302 and 312) at a later time, such as when activated (e.g. at a point of sale, shipping warehouse, user's home, etc. using printer 20), to thereby provide complete tokens (e.g., complete tokens 303 and 313).

Machine readable tokens 61 and 142 may comprise a bar code such as a PDF417 two dimensional barcode, a data matrix two dimensional barcode, a code128 one dimensional barcode, a POSTNET (bar and half bar encoding) one dimensional barcode, and/or the like. Additional or alternative forms of machine readable symbology which may utilized according to embodiments of the invention include universal product code (UPC), code 93, dotcode, magnetic ink character recognition (MICR), etc. Tokens may additionally or alternatively be provided in other forms, such as human readable characters (e.g., letters, numerals, and/or symbols), graphic images, and/or the like. Machine readable embodiments of tokens 61 and 142 are provided in a form consistent with the information based indicia (IBI) acceptable to postal authorities, such as the United States Postal Service. Tokens 61 and 142 need not include all the information of a full IBI, such as where tokens 61 and 142 comprise a "light" IBI implementation as shown in the above referenced patent application entitled "Computer-Based Value-Bearing Item Customization Security."

A robust barcode such as the aforementioned PDF417 and data matrix barcodes are preferred according to embodiments of the invention in order to encode a relatively large amount of information therein, to provide data redundancy for error correction, to provide data security, etc. A one dimensional barcode such as the aforementioned POSTNET and code128 barcodes are preferred according to some embodiments of the invention in order to provide encoded data in a form which is readily scanned using relatively inexpensive and/or which is widely available. Of course, multiple machine readable portions may be included as part of a machine readable token, such as to include a robust two dimensional barcode and a widely readable one dimensional barcode, to accommodate a large variety of use scenarios if desired.

Tokens 61 and 142 may be printed using media which is visible in natural light, which is invisible in natural light, or a combination thereof (e.g., partially visible in natural light and partially invisible in natural light) according to embodiments of the invention. For example, tokens 61 and 142 provided according to embodiments of the invention may be printed using traditional inks, toners, thermally activated components, etc. to provide an indicia which is visible in natural light. Additionally or alternatively, tokens 61 and 142 of embodiments of the invention may be printed using an ink which is invisible in natural light. Printed matter using such ink may be viewed using light of an appropriate wavelength, such as light in the ultraviolet spectrum. Additional detail with respect to indicia which is invisible in natural light is provided in the above referenced patent application entitled "Invisible Fluorescent Ink Mark."

Visibility of indicia which is initially invisible may be transient (e.g., visible only when light of the appropriate wavelength is present) or more permanent (e.g., chemically or molecularly changing to remain visible after light of the appropriate wavelength to "develop" the image is removed). Detail with respect to the use of bistable indicia as may be used as the tokens herein is provided in the above referenced patent application entitled "Systems and Methods for the Distributed Activation of Postage." The use of such bistable tokens, rendered visible at activation, may provide additional security and fraud prevention with respect to postage indicia of the present invention.

Postage stock 141 preferably includes a code or other identifying information useful in substantially uniquely identifying the postage stock and/or the tokens printed thereon. For example, code 143 included on postage stock 141 may include a serial or sequence number, identification information, digital signature, cryptographic key, and/or the like useful in substantially uniquely identifying postage stock 141 and/or tokens 61 and 142 printed thereon. Client system 10 and activation system 110 preferably records such identification information in databases 12 and 112, respectively, such as part of the data of token information 14 and unassigned tokens database 114, respectively, for use in activating the postage indicia.

Additionally or alternatively, tokens 61 and 142 may include a code or other identifying information useful in substantially uniquely identifying the tokens. For example, codes included in the tokens may include serial or sequence numbers, identification information, digital signatures, cryptographic keys, and/or the like useful in substantially uniquely identifying the tokens and/or the postage indicia created therewith. Client system 10 and activation system 110 preferably records such identification information in databases 12 and 112, such as part of the data of token information 14 and unassigned tokens database 114, for use in activating and/or verifying the postage indicia.

According to embodiments of the invention, information, such as the activation status of tokens, is stored in databases 12 and 112. For example, when tokens 61 and 142 are generated, client system 10 and activation system 110 may store a substantially unique code identifying each generated token in databases 12 and 112 along with a status identifier indicating the tokens are "unactivated" or "unassigned". As discussed below, the status identifier may be updated upon activation of the tokens when postage indicia has been purchased and activated to indicate the indicia are "activated." Such status identifiers may be useful with respect to validation of the indicia, as discussed further below. Additional or alternative information which may be stored in association with tokens may include identification of an entity or account for which the tokens were generated (e.g., a business requesting the tokens for their inventory or their use in mailing postal items), an entity generating the tokens (e.g., a service provider generating the tokens), identification of a system used to generate the tokens, cryptographic keys used for encrypting/decrypting information in the tokens, digital signatures used to authenticate the tokens, information regarding geographic areas mail items bearing indicia using the tokens may be introduced into a mail processing stream and/or geographic areas mail bearing indicia using the tokens may be delivered to, particular services and/or levels of service indicia bearing the indicia may be used for, delivery confirmation numbers, signature confirmation numbers, and/or the like. Such additional information may be used in an audit trail with respect to any particular token or indicium created therewith, used to detect fraud or abuse of tokens and indicia crated therewith, used for accounting purposes, used to restrict or manage the use of tokens or indicia created therewith, etc.

Although embodiments are described above with respect to providing information to identify an entity or account for which tokens and/or indicia created therefrom were generated, tokens and indicia provided according to embodiments of the invention, both before activation and thereafter, may be anonymous (e.g., a user of the indicia is not identified by the indicia, as with a traditional postage stamp). Likewise, although embodiments are described above with respect to providing tokens and indicia which are geographically restricted (e.g., having a limitation with respect to a source and/or destination address associated with the use of the postage indicia), it should be appreciated that tokens and indicia provided according to embodiments of the invention may be geographically ambivalent (e.g., having no limitation with respect to a source or destination address associated with use of the postage indicia).

Tokens of embodiments of the invention may be printed alone or in combination with various images, information, characters, symbols, ornamental images, and/or marks (collectively referred to as marks). For example, tokens may be printed alone, with one or more marks used to facilitate processing of indicia (e.g., a facing identification mark (FIM)), with human readable information, with one or more indicator marks, and/or the like. Such marks may be used in preparing mail items, processing mail items, for aesthetic or other purposes, etc.

Moreover, the tokens used according to embodiments may be provided in forms other than pre-printed embodiments. For example, tokens utilized according to embodiments of the invention may comprise radio frequency identification (RFID) tags embedded in or affixed to postage stock 141, if desired.

At block 202 of FIG. 2, postage stock 141 of the illustrated embodiment, having tokens 61 and 142 thereon, is provided to a number of locations (e.g. points of sale, shipping warehouses, users' homes, etc.) for use in activating the tokens into postage indicia. For example, postage stock 141 may be provided to a retail merchant, a kiosk service provider, a business operator, etc. associated with client system 10 or point of sale system 120, preferably as part of a plurality of postage stock, for later use in activation into postage indicia. If the user is selling tokens at a point of sale, the user can offer postage indicia to the public without investing appreciable monies in postage value, without risk of theft of postage value, without risk of postage rate changes rending their stock stale, and/or the like. Likewise, if the user is a shipping warehouse operator, the user can store plenty of tokens without investing appreciable monies in postage value, without risk of theft of postage value, without risk of postage rate changes rending their stock stale, and/or the like.

A user selects postage stock for activation as postage indicia at block 203. For example, in the point of sale example, the user may select postage stock from a retail shelf or within a bin of a vending machine. In the shipping warehouse example, an employee may select a token from a token storage location. Such token may be printed on a particular stock suitable for a particular use, such as a sheet of labels to provide a plurality of postage indicia for use in posting multiple mail items, a box of envelopes to provide both a plurality of indicia and a corresponding plurality of mail item containers for use in posting multiple mail items, a single "flat" (e.g., bubble pack envelope) to provide postage indicia and a container for mailing a large item, etc. Additionally or alternatively, the postage stock may comprise tokens suitable for a particular use, such as tokens having a desired preestablished postage denomination associated therewith (e.g., $0.44) suitable for a particular mail item, tokens which are denomination agnostic to facilitate activation of postage indicia having one or more desired postage value(s), etc. The postage stock may further comprise desired ornamental images, such as a national flag to commemorate a national holiday, a religious icon to celebrate a religious holiday, a matrimonial icon to celebrate a wedding or anniversary, etc.

At block 204, the selected postage stock is presented to the activator for activation of the token(s) as valid postage indicia. In a point of sale scenario, the activator may be a clerk at a point of sale operating scanner 123 or a GUI. In a shipping warehouse scenario, the activator may be an authorized employee operating scanner 21 or GUI 19. Having selected the desired postage stock, the user is thus ready to activate the token into postage indicia. Scanners 21 or 123 may be utilized to scan code 143 included on postage stock 141 (and thus included on selected postage indicia stock 151) and/or one or more of tokens 61 and 142 for identification of the token(s) to activate as postage indicia. This information may be provided to client system 10 or activation system 110 for identification of the appropriate tokens, such as within token information 14 or unassigned tokens database 114, and activation of those tokens as valid postage indicia. Activation of the tokens may comprise moving data associated with particular tokens from token information 14 or unassigned tokens database 114 to indicia information 15 or assigned tokens database 115 and/or to database 132 of validation system 130 (which can be operable with system 10 and/or system 100).

The user may provide information in addition to selection of desired postage stock according to embodiments of the invention. Some or all of this additional information may be provided to client system 10, activation system 110, point of sale system 120, and/or validation system 130. The user may, for example, select amounts of postage for the desired postage indicia, a class of mail, an account for payment of postage services and/or postage value, etc. Scale 129 may be utilized by a user to obtain a weight of one or more mail items for determining an amount of postage for the desired personalized postage indicia. For example, a user may present a postal item (e.g., letter or parcel) at a point of sale, such as at the checkout aisle illustrated in FIG. 1C. The postal item may be weighed by scale 129 and the selected postage stock scanned by scanner 123. Rating information may determine an appropriate postage value and operation as described herein provide activation of the token(s) as valid postage indicia having appropriate postage value. Client system 10 and point of sale (POS) system 120 may comprise rating tables, or may interface with another system such as validation system 130 having rating tables, for determining an amount of postage.

The tokens on the selected postage stock are activated as valid postage indicia at the point of sale at block 205. Client system 10 and activation system 110 preferably operate to change the status of tokens 61 and 142 from "unactivated" to "activated." For example, client system activation system 110 may locate the substantially unique code or other information provided by GUI 19, scanner 21, or scanner 123 and change status information of tokens in token databases 12 and 112, such as by changing a status indicator stored in association with the substantially unique code, by moving the substantially unique code from an "unactivated" portion of the database to an "activated" portion of the database, and/or the like. Such a change in status, according to embodiments of the invention, results in the postage indicia comprising the tokens becoming a valid postage indicia or a value bearing indicia.

As an example of the foregoing operation at block 205, the postage stock, having token printed thereon, may have been distributed to various locations such as points of sale (e.g., pharmacies, department stores, office supply stores, discount retailers, photocopy print shops, grocery stores, etc.), shipping warehouses, business's mail rooms, user's homes, etc. for use in activating postage indicia.

Tokens at point of sale locations may be sold to patrons using a substantially traditional payment model (e.g., payment by a purchaser to a retail merchant by cash, check, credit card, debit card, etc.). For example, payments may be made from a patron to a clerk at a retail location. Thereafter, an amount sufficient to pay for activated postage indicia can be transferred from the retail location to a postage service provider. This postage service provider may prepay or postpay a postal authority (e.g., the USPS). Once a postage service provider determines the amount of postage value associated with postage indicia being activated, the postage service provider can update ascending and descending registers of a postage security device for appropriate accounting to the postal authority. Other payment models may additionally or alternatively be implemented according to embodiments of the invention.

Equipment of client system 10 or POS system 120 of the retail outlet may scan the postage stock substantially unique identification (e.g., using a barcode scanner, a MICR reader, an RFID scanner, optical character recognition (OCR) system, etc.) to identify the particular postage stock, and thus the token, for assigning those tokens as live postage. This identification information, preferably accompanied by additional information (e.g., desired number of postage indicia, postage indicia amount, identification of image(s) included as postage indicia, postage class, account for payment of postage value, etc.) may be provided to an entity for assigning or activating the tokens as live postage and/or other processing, such as a postage service provider which initially produced the tokens for activation of the tokens. The identification information is used to assign or activate tokens, and thus the postage indicia generated therewith, to provide live postage indicia acceptable to a postal authority. Information identifying the now assigned tokens may be stored in a database to thereby activate the tokens. Other information may additionally or alternatively be stored in association with activated tokens, such as user information (e.g., user identification, payment information, etc.), point of sale or activation information (e.g., retailer identification, activation location, etc.), and/or the like.

Of course the client system 10 or POS system 120 is able to scan other substantially unique identification information to identify and activate one or more tokens such as a barcode included in the token itself, a delivery confirmation barcode and/or number, or a signature confirmation barcode and/or number. It should be understood that a delivery confirmation barcode and/or number is a barcode or number used to confirm various details of a mail item's delivery (e.g., date, time, city, state, and/or ZIP code of delivery, information regarding delivery attempts, and/or information about forwarding or returning). It should be further understood that a signature confirmation barcode or number is used to solicit a signature by the recipient (or a person accepting the item on behalf of the recipient) at the time of delivery of the mail item. Any one of the postage stock identification number, token barcode, or other identification information (e.g., delivery confirmation number and/or barcode, signature confirmation number and/or barcode) or any combination thereof could be used in validating the token in any embodiment of the invention disclosed herein.

Embodiments of client system 10 and activation system 110 preferably operate to facilitate accounting for and/or validating postage indicia. For example, client system 10 and activation system 110 may provide access to, or information from, databases 12 and 112 to validation system 130 for use in validating postage indicia which have been introduced into the mail processing stream. The foregoing information may, according to embodiments, include information in addition to information identifying activated tokens. For example, the foregoing user information may include user identification, information regarding a credit card or other account used to purchase the indicia and/or postage value, etc., may be provided to validation system 130 for use in fraud detection, providing an audit trail, payment error correction, etc. Additionally or alternatively, client system 10 and activation system 110 may communicate the fact that the token has been activated and/or other information, such as a value of the activated indicia, to point of sale system 120 and/or validation system 130 for use thereby.

Embodiments of client system 10 and activation system 110 operate to do more than change a status of a database record associated with tokens 61 and 142. For example, embodiments of the invention may utilize information provided with the aforementioned substantially unique code, such as postal item weight, postal class, origination location information, destination information, and/or special handling instructions, in order to determine a postal rate, to provide statistical reporting, etc. Moreover, as discussed below, client system 10 and activation system 110 may additionally or alternatively operate to debit an account (or otherwise account for postage value) for the appropriate postal value, such as using the aforementioned determined rate or the desired postage amount transmitted with the substantially unique code. Embodiments of the invention may collect value or fees in addition to a postage amount, such as to collect a surcharge for the point of sale activation service described herein. Additional functions, such as dispatching a courier to retrieve mail items, scheduling postal processing resources, providing reports, etc. may be performed by or in response to client system 10 and activation system 110 activating indicia.

Various forms of scanners may be utilized as scanners 21 and 123 of embodiments of the invention. For example, traditional optical scanner configurations, such as may comprise flatbed scanners, sheet fed scanners, handheld scanners, camera based scanners, or the like may be used with respect to indicia which is visible in natural light. Where tokens are used which are not visible in natural light or which are configured to be bistable, scanners used according to the present invention may be adapted for use therewith, such as by substituting or adding an illumination lamp operable to radiate a desired wavelength of light (e.g., ultraviolet, infrared, etc.). However, lamps used with respect to many commonly available scanners are broad-spectrum enough to cause many ultraviolet and other inks to fluoresce, thereby making it possible in many circumstances to use more traditional optical scanner configurations even with respect to specialized indicia configurations. Scanners implemented according to embodiments of the invention may additionally or alternatively employ technology other than optical scanner technology. For example, radio frequency (RF) scanner technology may be utilized with respect to identification codes and/or tokens borne in RFID tags. Of course, activation devices could be equipped with other input means such as touch screens, keypads, keyboards, voice recognition, etc. such that a user can manually or verbally input a token's substantially unique code and/or other information.

Although embodiments are described above with reference to scanners 21 and 123 operating to scan postage stock code 143 and/or tokens 61 and 142, it should be appreciated that the use of such a scanner may be omitted according to embodiments of the invention. For example, where postage stock code 143 and/or tokens 61 and 142 comprises human readable information providing the aforementioned substantially unique code or other suitable information, whether in combination with machine readable symbology or alone, a user may manually input the information into GUI 19 or point of sale system 120, such as through POS terminal 124. Moreover, as discussed in further detail below, embodiments of the invention which activate tokens may utilize a SCAN form, rather than a scanner, to activate tokens.

The payment for postage value may be provided directly from a user, indirectly from a user through an activation service provider (e.g., retailer), indirectly from a user through a postage service provider (e.g., Internet postage provider), directly from an activation service provider, indirectly from an activation service provider through a postage service provider, etc. Such accounting for such postage value payment may be made through incrementing an ascending register and decrementing a descending register, as is typical of a postage meter operation, or through a payment transaction more traditionally used outside of postage metering applications (e.g., without the use of secure ascending and descending registers). For example, prepaid accounts, postpaid accounts, electronic funds transfer, electronic commerce, and/or the like may be used according to embodiments of the invention. However, according to a preferred embodiment, a postage service provider operating activation system 110 will not pay a postal authority, such as the USPS, postage value for a token unless and until that token is included in postage indicia and activated. Detail with respect to accounting for postage value as may be utilized according to embodiments of the invention is shown in the above referenced patent application entitled "Virtual Security Device."

Scanner 123 at point of sale system 120 (of FIG. 1B) or scanner 21 at client system 10 of FIG. 1A may additionally or alternatively operate to provide indication that tokens 142 or token 61, and thus the postage indicia, have been activated. For example, where one or more bistable marks are included in association with tokens 142 or token 61, scanner device 123 or scanner 21 may operate to "develop" the mark (or an appropriate one of a plurality of marks) through exposure to a particular wavelength of light, an appropriate amount of heat, an appropriate frequency of radio frequency energy, an appropriate chemical, a suitable magnetic field, etc., upon activation of the indicium. Detail with respect to developing marks to show activation is provided in the above referenced patent application entitled "Systems and Methods for the Distributed Activation of Postage." The foregoing bistable marks need not be utilized to provide the foregoing information or other information on the mail items at the time of activation according to embodiments of the invention. For example, a mark printed by POS terminal 124, printer 128 (of FIG. 1B), or printer 20 (of FIG. 1A) may print symbols or information indicating activation of the postage indicia.

Figure 3B:
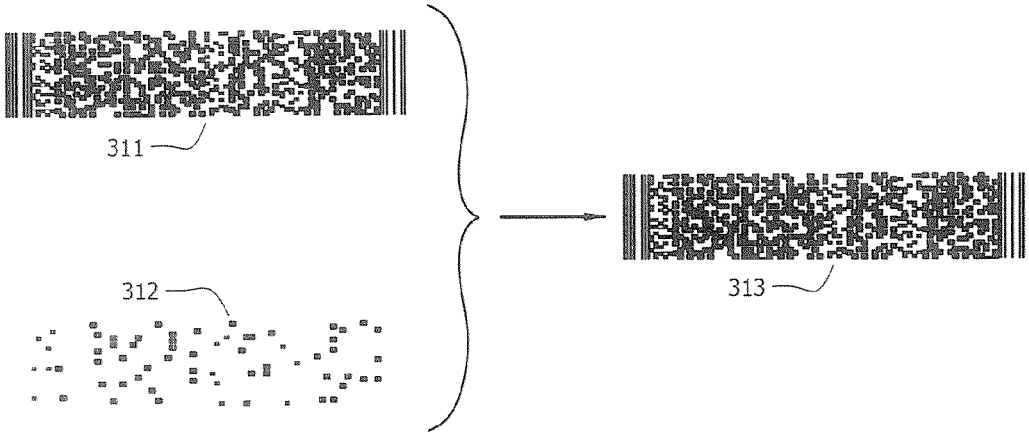
Figure 4:
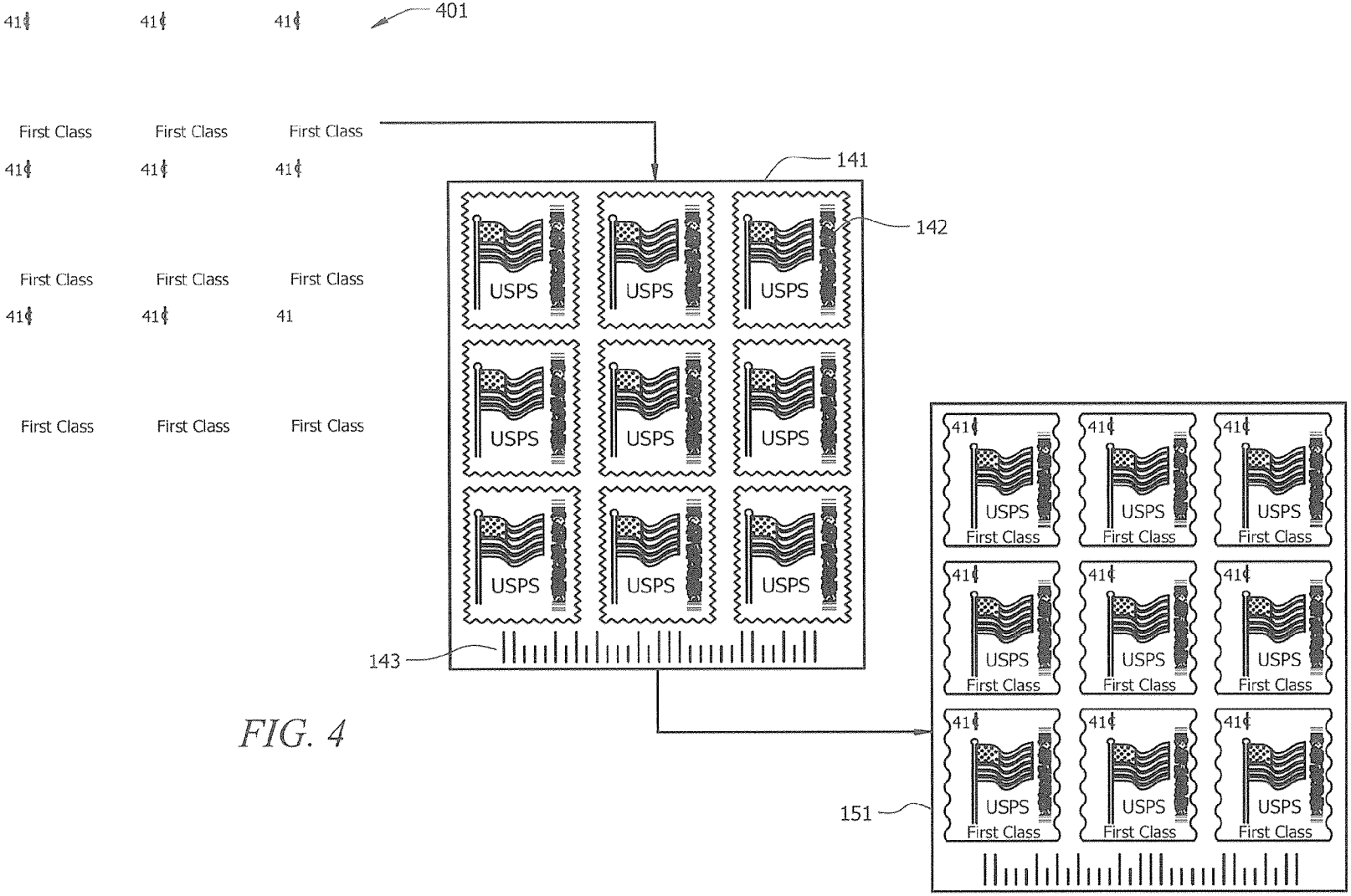
FIG. 4 shows information assembled into an appropriate format for printing a token according to an embodiment of the invention.

Information may be added to the postage stock, and/or tokens thereon. For example, an amount of the postage value, postal class, etc. may be printed on the postage stock (as shown in FIG. 4). For example, where tokens are denomination agnostic, a postage value consistent with that selected by the user may be printed upon postage stock 141 by printer 20 or printer 128. Likewise, where fractional tokens are provided on postage stock 141 (e.g., partial token 301 of FIG. 3A or partial token 311 of FIG. 3B), the missing portions of such tokens may be provided by client system 10 or activation system 110 for printing by printer 20 or printer 128, thereby providing complete tokens (e.g., complete token 303 of FIG. 3A and complete token 313 of FIG. 3B).

The foregoing information to be added to the postage stock is preferably assembled in an appropriate format and/or including appropriate information added thereto and provided in an electronic file (e.g., file 401 of FIG. 4) for transmission to client system 10 or to a point of sale location. It should be appreciated that security is not really an issue with respect to communication of a file containing the foregoing information because the file only contains information (and perhaps partial tokens) and does not contain any active or complete postage barcodes or similar indicia. Therefore, if the file is intercepted or stolen the intercepted or stolen information is not valuable. With the lower security requirements around protecting such a file, the file may be transmitted across the public Internet with minimal, if any, security using FTP, HTTP, etc. Additionally, the file may be printed without a local client application at the point of sale location (e.g., using a pure web browser application or other application). However, security techniques, such as encryption of the file for transmission between server 31 and client system 10 or between activation system 110 and point of sale system 120, may be implemented if desired.

According to embodiments of the invention, the postage indicia of postage stock 151 remains not active (i.e., tokens 61 and 142 remain unassigned or unactivated) until completion of the activation. Thus, if an error occurs during printing (but before tokens 61 and 142 are activated), the foregoing file can simply be printed again immediately on new postage stock. The misprinted item produced does not need to be saved or returned (perhaps just destroyed) as it is not valid postage.

At block 206 activated postage indicia is utilized to post mail items. For example, a postage indicia may be removed from postage indicia stock 151 and applied to mail item 134, and mail item 134 may be introduced into the mail stream.

Postage indicia, or a statistical sampling thereof, is preferably validated (e.g., before mail processing, during mail processing, and/or after mail processing) at block 207. Note that this validation step can be used in operation of any system or method of activation disclosed herein. For example, mail piece scanner 133 of validation system 130 may obtain information from the postage indicia for use with information stored in database 12, 112 and/or 132 (e.g., comparison of the scanned information to the stored information) in order to validate the indicia. Mail piece scanner 133 may thus comprise traditional optical scanner configurations, such as flatbed scanners, sheet fed scanners, handheld scanners, camera based scanners, or the like when indicia which is visible in natural light are used. As with scanner device 123 discussed above, where tokens are used in the postage indicia which is not visible in natural light, mail piece scanners used according to the present invention may be adapted for use therewith, such as by substituting or adding an illumination lamp operable to radiate a desired wavelength of light (e.g., ultraviolet, infrared, etc.). Likewise, mail piece scanners implemented according to embodiments of the invention may additionally or alternatively employ technology other than optical scanner technology, such as RF scanner technology where RFID tags are used.

According to embodiments of the invention, as a mail item is processed (e.g., at a mail service provider's mail processing station) after the mail item has been introduced into the mail stream, the mail piece is passed through mail piece scanner 133 for scanning indicium therein to obtain information such as the aforementioned substantially unique code. Validation system 130 may compare this information to information in database 12, database 132, and/or database 112 to determine if the postage indicium is a valid postage indicium. If the indicium is valid (e.g., is activated), validation system 130 may allow the mail item to pass for further processing (e.g., processing for delivery to an appropriate destination address). However, if the postage indicium is not valid (e.g., the token therein is unactivated), validation system 130 may prevent further processing (e.g., direct the mail item to a "return to sender" bin) and/or may provide additional processing, as described in further detail below. Various audit processing may also be performed by client system 10, activation server system 110, and/or validation system 130, such as to detect fraud or abuse of indicia, used for accounting purposes, etc., using the aforementioned indicia information during processing of mail items or thereafter.

Processing of indicia which validation system 130 determines to be unactivated may comprise more than rejecting the mail item for delivery. For example, validation system 130, perhaps in cooperation with client system 10, activation system 110, and/or point of sale system 120, may operate to decrement an appropriate account (e.g., the appropriate users' account, an account of a service provider providing the pre-produced indicia, etc.) or otherwise issue an invoice or collect for the postal value. Collection of postal value in such a situation may not be limited to the actual postage amount, but may include a surcharge associated with misuse of the indicia. Such additional processing may additionally or alternatively include notifying a user of the detected misuse of indicia, statistical analysis of indicia usage (e.g., to detect fraud or attempted fraud), etc.

In addition to or in the alternative to validation system 130 scanning mail items after their introduction into the mail stream, embodiments of the invention may operate to perform at least some level of validation at or very near the time a mail item is introduced into the mail stream. For example, a postman initially picking up a mail item for entry into the mail stream may make a determination as to whether the indicia has been activated (e.g., through reference to one or more visible bistable mark, through scanning the indicia, etc.) and/or whether the indicia has the appropriate amount of postage value for the mail item (e.g., through reference to a visible indication of postage value, through scanning the indicia, etc.). Accordingly, the postman may be provided with various devices useful according to embodiments of the invention, such as a portable version of mail piece scanner 133.

From the above it can be seen that operation according to the embodiment of FIG. 2 provides postage indicia for mailing documents, wherein the postage indicia is activated at any of a number locations (e.g. points of sale, shipping warehouses, users' homes). Embodiments as described herein facilitate implementations which may readily be deployed at point of sale locations, such as retail locations. For example, because neither the postage stock nor the information files used according to embodiments of the invention contain complete or live postage indicia, the loss or theft of either does not result in the loss or theft of postage indicia.

Moreover, embodiments of the present invention facilitate users conveniently obtaining postage indicia, such as may comprise a number of indicia, a value of postage, a class of service, a type of postage stock, etc. desired, without the user needing processor-based systems, a postage account, etc. Moreover, retail locations, shipping warehouses, business mail rooms, etc. are enabled to conveniently stock postage for their patrons and employees without having appreciable monies tied up in an item that runs a risk of becoming stale with a change in postal rates. Moreover, because highly secure client server software is not required according to embodiments of the invention, terminals used in providing activation of postage indicia according to embodiments of the invention may comprise widely available terminal configurations adapted to interface with an activation system as described herein.

Embodiments above have been described with reference to centralized printing of tokens for distributing to various locations. The concepts of the present invention, however, are not limited to such embodiments. For example, printers 20 and 128 may be utilized to print batches of postage stock. In such an embodiment, computer platforms 11 and 121 may interact with postage provider 30 and activation system 110, respectively, to generate appropriate tokens and to store information for use in activating the tokens in corresponding databases 12 and 114. Detail with respect to processor-based systems cooperating to generate and print information based indicia as may be used as tokens according to embodiments of the present invention is provided in the above referenced patent applications entitled "System and Method for Generating Postage Indicia," "System and Method for Printing Multiple Postage Indicia," and "Computer-Based Value-Bearing Item Customization Security."

Although embodiments have been described herein with reference to the use of printed tokens, it should be appreciated that other forms of tokens may be utilized according to embodiments of the invention. For example, RFID tags may be applied to or embedded in postage stock for use according to the concepts of the present invention.

It should be appreciated that, although embodiments have been described above with reference to use of indicia in a postage context, the concepts of the present invention may be utilized outside of a postal system. For example, indicia according to embodiments of the present invention may be used with respect to various transactions, such as in business commerce.

Although embodiments have been described herein with reference to activating a plurality of postage indicia (e.g., a sheet of postage indicia), it should be appreciated that embodiments of the present invention may be utilized to activate any desired number of postage indicia. For example, a single postage indicia may be activated in an iteration of the flow diagram of FIG. 2, if desired. Postage indicia which are activated according to embodiments of the invention may be part of a larger collection of postage indicia (e.g., 1 postage indicia of a sheet of many postage indicia) or may comprise an independent subset of postage indicia.

Payment at or Subsequent to a Point of Mail

Figure 5:
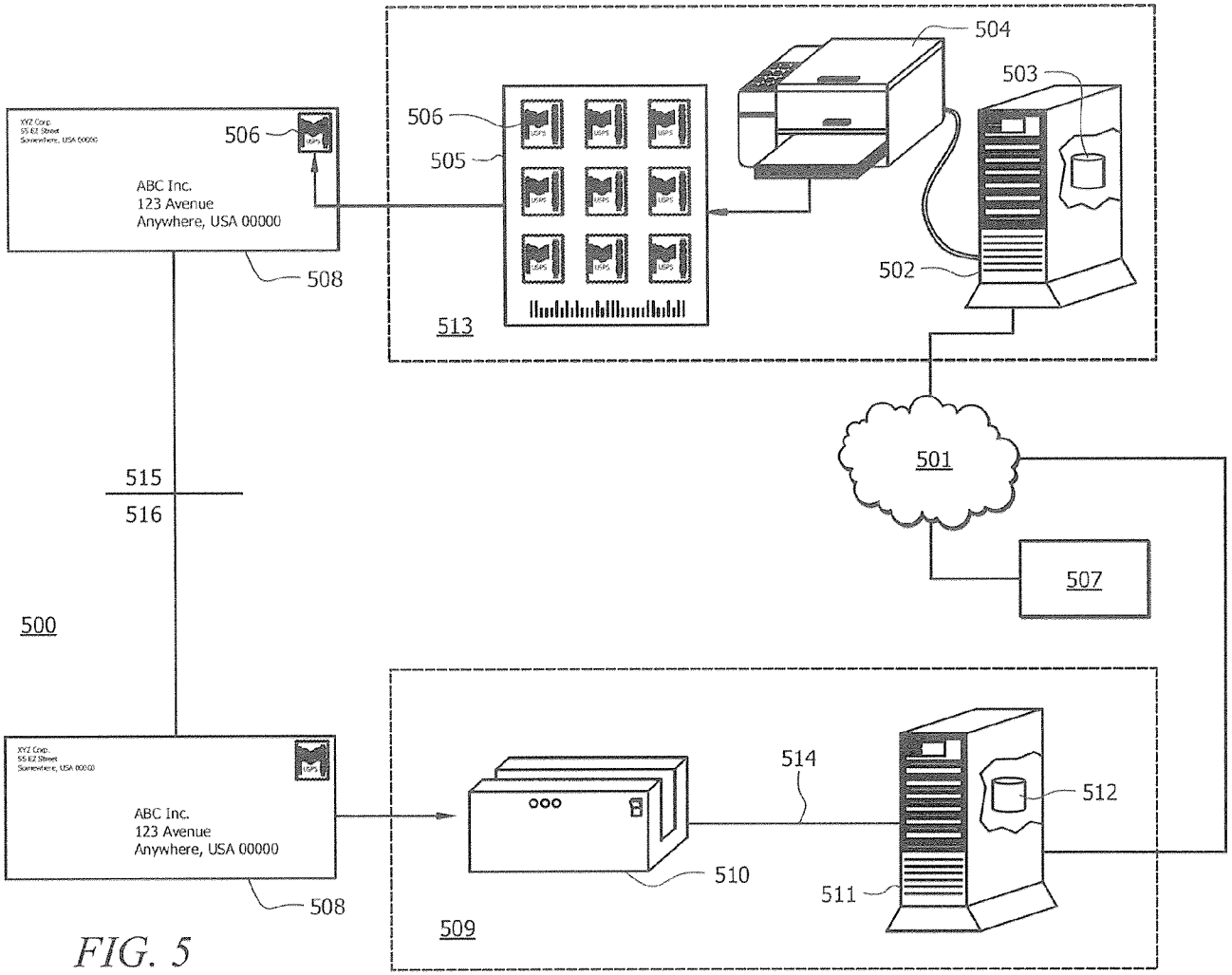
FIG. 5 depicts a system adapted to provide payment for a postage indicium at or subsequent to a point of mailing, according to embodiments of the invention.

FIG. 5 depicts an example of a system 500 that allows payment of postage indicia at or subsequent to a point of mailing, according to embodiments of the invention. Much of the systems and methods described above regarding are applicable to system 500 (for example, the token configurations, activation via token scanning, the validation system, etc.); therefore for brevity, they will not be repeated again.

System 500 of the illustrated embodiments comprises print portion 513 that is in communication with the payment portion 509 through network 501. Point of mailing refers to the point in the delivery process where the postal item leaves control of the shipping or mailing customer and enters control of the delivery service. For example, point of mailing may comprise a letter box, a delivery truck, a post office, standard pickup, or scheduled pickup.

Note that the print portion 513 and the payment portion 509 may be disposed locally or remotely with respect to one another. Other embodiments may have the print portion and the payment portion comprise one single device, e.g. a kiosk. Other embodiments may have the portions comprise separate devices. For example, the payment portion 509 may be located at a US postal system facility and the print portion 513 may be located at a residence or office. As another example, both the print portion and the payment portion may be located at a US postal system facility. Accordingly, network 501 of embodiments may comprise a network bus, the Internet, an intranet, an extranet, a local area network (LAN), a metropolitan area network (MAN), a wide area network (WAN), the public switched telephone network (PSTN), a wireless network, a cable transmission system, a satellite communication network, and/or the like.

Print portion 513 preferably comprises a processor-based system, such as a computer having a central processing unit (CPU), memory (shown as including database 503), and appropriate input/output (I/O) devices and interfaces, operable under control of an instruction set defining operation as described herein. For example, print portion 513 may comprise server platform 502 having a processor from the PENTIUM family of processors available from Intel Corporation, Santa Clara, Calif. Alternatively, the computer 502 could be a personal computer that could be used, for example, in a residence or small business. The software operative for generating the tokens could be local client software or web based such that it is configured to be used with a web browser. The print portion 513 comprises a printer 504 that is capable of printing tokens. The print portion 513 may be located at home or office. The print portion 513 may also be a kiosk or other station that is located in a public location, e.g. a street corner, or a publicly accessible location, e.g. an airport, a postal facility, a delivery facility, a store, central location, etc. Note that the print portion may be distributed with the printer at one location and the server that produces the data that is used to form the tokens at another location, for example the printer may be located in a home or office, while the server 502 is located at a USPS vendor, such as Stamps.com. Thus, the user would send the information for the tokens to the remote server, which would generate the data to form the tokens and send the tokens' data to the user's printer 504, which prints the tokens. Note that the tokens that are to be printed may be a JPEG or bitmap image. The data used to form the token instructs the computer or printer to form the JPEG bitmap image.

Print portion 513 of the illustrated embodiment provides printing of token and security may be provided by the indicium itself, by the information that is used in its creation, and through verification and authentication by the delivery service and/or an approved vendor of the delivery service, for example, see U.S. patent Ser. No. 11/323,462, entitled "HIGH SPEED PRINTING," filed Dec. 30, 2005, and U.S. patent Ser. No. 11/323,463, entitled "SYSTEMS AND METHODS FOR SINGLE PASS PRINTING POSTAGE INDICIA," filed Dec. 30, 2005, which are incorporated herein by reference in their entirety.

As discussed above, payment for the postage value can occur at or after the mailing of a postal item with the token. The money or value for the postage value is debited from an account when the token is activated. The account may comprise a register that holds value. The account may be a vault that is located local with the print portion. The account may also comprise a vault 507 that is located remote from both the print portion and the payment portion, e.g. a bank account, or an account maintained by an agent of the delivery service. The account may also comprise a vault that is located with the payment portion. Any of the accounts could be filled by the user of the printer, and maintained by the delivery service. In any event, the account would be accessible by the delivery service for payment of postage value upon token activation. Note that only one account (e.g. vault 507) is needed, and thus other accounts may not be present in the system. Vault 507 could be located at print portion 513, payment portion 509, or at a remote location (e.g. a bank or agent of a delivery service) as shown in FIG. 5.

Alternatively, the system could comprise multiple accounts or vaults located in any number of locations (e.g. as shown in FIG. 1A). Some vaults or accounts could be stored at the print portion 513 while other accounts or vaults are located at a remote location such as a bank or agent while still other vaults are located at the payment portion 509. Note, other methods can be used to make the user liable for the postage value.

As shown in FIG. 5, the printer 504 prints a plurality of tokens 506 on a sheet 505 of postal stock. Alternatively, the printer 504 may print a single token on a sheet of postal stock. As another alternative, the printer 504 may print the token directly on the postal item. Printer 504 is also capable of printing a delivery confirmation number in a human readable format and/or a machine readable format (e.g. a barcode), which is located separate from the token. Printer 504 can also print addressee information and/or addressor information on a label, postal stock, postal item, or any combination thereof. In any event, postal item 508 has one or more token 506 attached, applied or otherwise associated with it, and could have a separately located delivery confirmation number attached as well. Note that the postal item, as shown in FIG. 5 may comprise an envelope. The postal item may also comprise other shipping containers such as a package, a box, a carton, a tube, a parcel, a flat, a thick envelope, a postcard, etc.

At this point 515, the postal item 508 with the applied token 506 is still under the control of the shipper. The shipper may decide to place the item 508 in the stream of delivery at point 516, may decide to hold the item for later delivery to point 516, or may decide to dispose of the item without mailing. In any event, no liability for postage value has been assessed to the shipper at this time. Note that some embodiments (regardless of the activation means) may charge a reduced amount for each token that is created. Such a reduced charge may cover costs incurred for the creation of the token and discourage aberrant behavior or wasteful behavior.

At point 516, the shipper has placed mail item into the delivery stream and has surrendered control of the postal item to the delivery service. Point 516 may comprise a drop box controlled by the delivery service, a delivery service store, a delivery service person or agent, a delivery service collection point, standard pickup, scheduled pickup, etc.

After entry into the delivery system, the postal item 508 is passed into the payment portion 509 at some point in the delivery stream prior to being delivered to the recipient. Payment portion 509 preferably comprises a processor-based system, such as a computer having a central processing unit (CPU), memory (shown as including database 512), and appropriate input/output (I/O) devices and interfaces, operable under control of an instruction set defining operation as described herein. For example, payment portion 509 may comprise server platform 511 having a processor from the PENTIUM family of processors available from Intel Corporation, Santa Clara, Calif. The server includes database 512 that has software for validating the postage indicia of the postal item. Such validation may be performed as described above. The database 512 also includes software to access the account 507 of the shipper of the postal item and debt the account 507 for the postal costs of the postal item upon token activation.

The payment portion 509 also comprises a scanner 510 that scans the postal item and is connected to server 511 via connection 514. Note that the scanner 510 may be separate from the server 511, in this case the connecter 514 may comprise a network similar to that of network 501. The scanner may be located adjacent to or in the same facility as the server 511, in this case, the connecter 514 may comprise a wire or wireless connection. The scanner may be a handheld scanner that is operated by a delivery service person or agent. The scanner may comprise a scanner that is located in a vehicle operated by a delivery service person or agent. The scanner may be located in a building that is used by the delivery service, e.g. a drop-off store, a processing center, or a pickup store. The scanner could be located at the place the mail item is being delivered. The scanner may comprise a piece of equipment that is used in a processing stream of a processing center. The scanner may be located in the mail slot of a mail box, e.g. a "blue box". The scanner may also be located with the printer, e.g. in a kiosk that prints the token. The servers 502 and 511 may be located remote from the kiosk. Thus, the scanner may be located at the point of mailing, or may be located after the point of mailing; however, the scanner is located at a point prior to the point where the delivery service provider gives control of the item to the recipient.

The scanner scans the token 506 of the postal item 508. The scanner may also scan the delivery confirmation number, recipient address and/or the shipper address from the postal item or any other information on or associated with the mail item. The scanned information is then sent to the server 511. The server 511 then uses the scanned information to identify the account 507 of the shipper (or a responsibly party for the shipper). Accordingly, because some or all of the delivery confirmation number, token 506, address number, etcetera can be scanned (or otherwise identified to the system as disclosed herein), server 511 could use any or all of the information to identify account 507 of the shipper. For example, server 511 could rely on only the delivery confirmation number in identifying account 507, or the token information, or a combination of address information and delivery confirmation information, etcetera. Once account 507 is identified, the server then deducts the postage value from the account or otherwise makes the shipper liable for the postage value and activates the token into a valid postage indicium. After scanning, the postal item continues processing and/or handling by the delivery service, until the postal item is provided to the recipient. The account may be deducted immediately after scanning and identification, or may be deducted on a periodic basis. For example, a shipper that sends a plurality of items may have their account debited on a daily basis, e.g. at the close of each business day, for all items scanned during the that day. Note that the scanner may comprise a single device with server 511, may be separate from the server 511 and located in the same facility, or may be remote from the server 511.

Note that the value may be determined at the printing portion 513. The computer 502 may receive various inputs, e.g. weight from a scale (not shown), and data from the shipper, e.g. the recipient address, the shipper address, desired class, desired delivery time, special services, package description, etc., and determine the cost of mailing the postal item. The cost may then be expressed on the postage indicia, e.g. encoded into the bar code, or printed as a human readable number of the postage indicia. The scanner 510 would then read the encoded value or the printed number to read the cost of delivering the item. Accounting software (not shown) located in the printing portion may track the unscanned postage indicia, and thus provide the shipper with expected mailing costs.

Alternatively, the value may be determined at the payment portion 509. The computer 511 may receive various inputs, e.g. weight from a scale (not shown), and data from scanner 510, e.g. the postage indicia, the recipient address, the shipper address, mail class, special services, package description (e.g. envelope, flat, package, size information, and/or value of contents), etc., and determine the cost of mailing the postal item. The account is then debited, or otherwise reflects liability, for the postage value of the item. For auditing purposes, the system could have value determined at the printing portion 513 and payment portion 509. With two payment determinations, the postage value amount determined by printing portion 513 could be checked against the postage value amount determined by the payment portion 509. Such a double check could be useful in determining whether the printing portion equipment and/or software or payment portion equipment and/or software is malfunctioning, for accrual of statistical information, and/or to detect fraud at either the printing portion 513 or payment portion 509.

If the account has insufficient funds for the transaction, the print portion 513 will be disabled from printing additional postage indicia until the postage due has been cleared. If a shipper desires to close the account, the printing portion 513 is disabled from printing additional postage indicia, and the account maintained for a time period, e.g. 30 days, to ensure that unscanned items in the delivery stream are properly paid for. For more information on handling payment errors see U.S. patent Ser. No. 11/616,546, entitled "System and Method for Handling Payment Errors with Respect to Delivery Services," filed Dec. 27, 2006, which is incorporated herein by reference.

Figure 6:
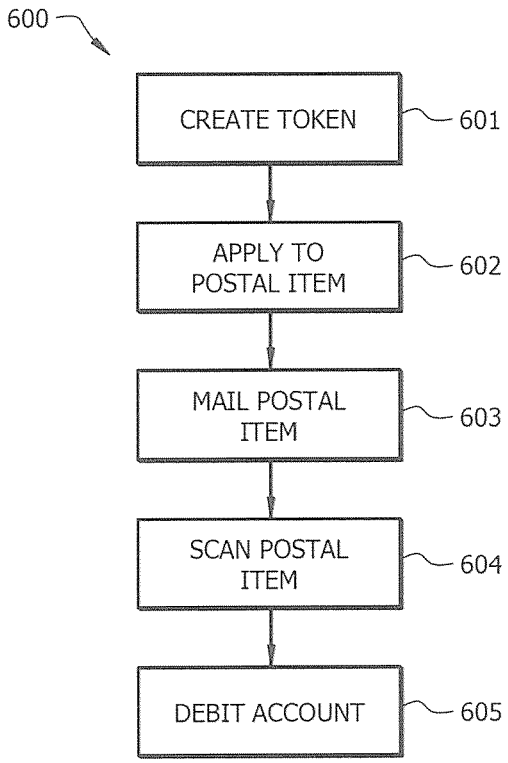
FIG. 6 depicts a method adapted to provide payment for a postage indicium at or subsequent to a point of mailing, according to embodiments of the invention.

FIG. 6 depicts a method 600 that allows for payment for a postage value at or subsequent to a point of mailing. The method begins by creating a token, block 601. The token can be created using client software or web based software through use of a web browser or other web interface. The token contains information that identifies an account. The token also contains information that is substantially unique from other tokens and postage indicium. According to embodiments of the invention, the method could also create a delivery confirmation number (not shown in figure). The method then applies the postage token to a postal item, block 602. If a delivery confirmation number was generated, then the method could also apply the delivery conformation number to the postal item, as described herein. The token may be directly printed onto the postal item or may be printed onto a sheet or roll of postal stock, which is then adhered to the postal item. The postal item is then placed into a delivery service's stream of mail handling, or point of mailing, block 603. Either contemporaneous with or subsequent to mailing the postal item, the postal item is scanned by a scanner, block 604. The scanner reads the account information from the token and provides the account information to a computer processor either located in the scanner or remote from the scanner, which then accesses the account and charges, or otherwise makes the shipper liable, for the cost of delivery of the postal item to the account. Additionally or alternatively, the scanner could read the delivery confirmation number and provide the information to the computer processor, which determines which account is associated with the delivery confirmation number and charges, or otherwise makes the shipper liable, for the cost of delivery of the postal item to the account.

In embodiments of the invention, the token is activated using a GUI operating on a device in the possession of the delivery service provider. The delivery service provider agent (e.g. a mail person, truck driver, pilot, and etcetera) could input the token information or the delivery confirmation number into the GUI for token activation.

Alternatively, the token information or delivery confirmation number could be provided to the delivery service provider in an electronic file which could be received by the delivery service provider or the postage service provider wirelessly or through a wired connection. For example, the token information and/or delivery confirmation number information could be included in an RFID and received by an RFID reader for use in token activation. In another example, the token information and/or delivery confirmation number information could be included in an email (and/or an attachment thereto) received by the delivery service provider or the postage provider for use in activation. The electronic file could be pushed to the delivery service provider and/or postage provider or retrieved by the delivery service provider and/or postage provider.

Embodiments of the invention allow shippers to incur delivery costs proximate to actual shipping of items, rather than during packaging of items. Embodiments allow shippers to save time and effort by not having to track whether or not the item has been mailed. Shippers can easily reprint a token in case of loss or error, without having to seek reimbursement for lost erroneous indicia. Shippers also save time and effort by not having to seek reimbursement for unshipped items.

Payment Subsequent Indicia Creation and Prior to a Point of Mail

Figure 7A:
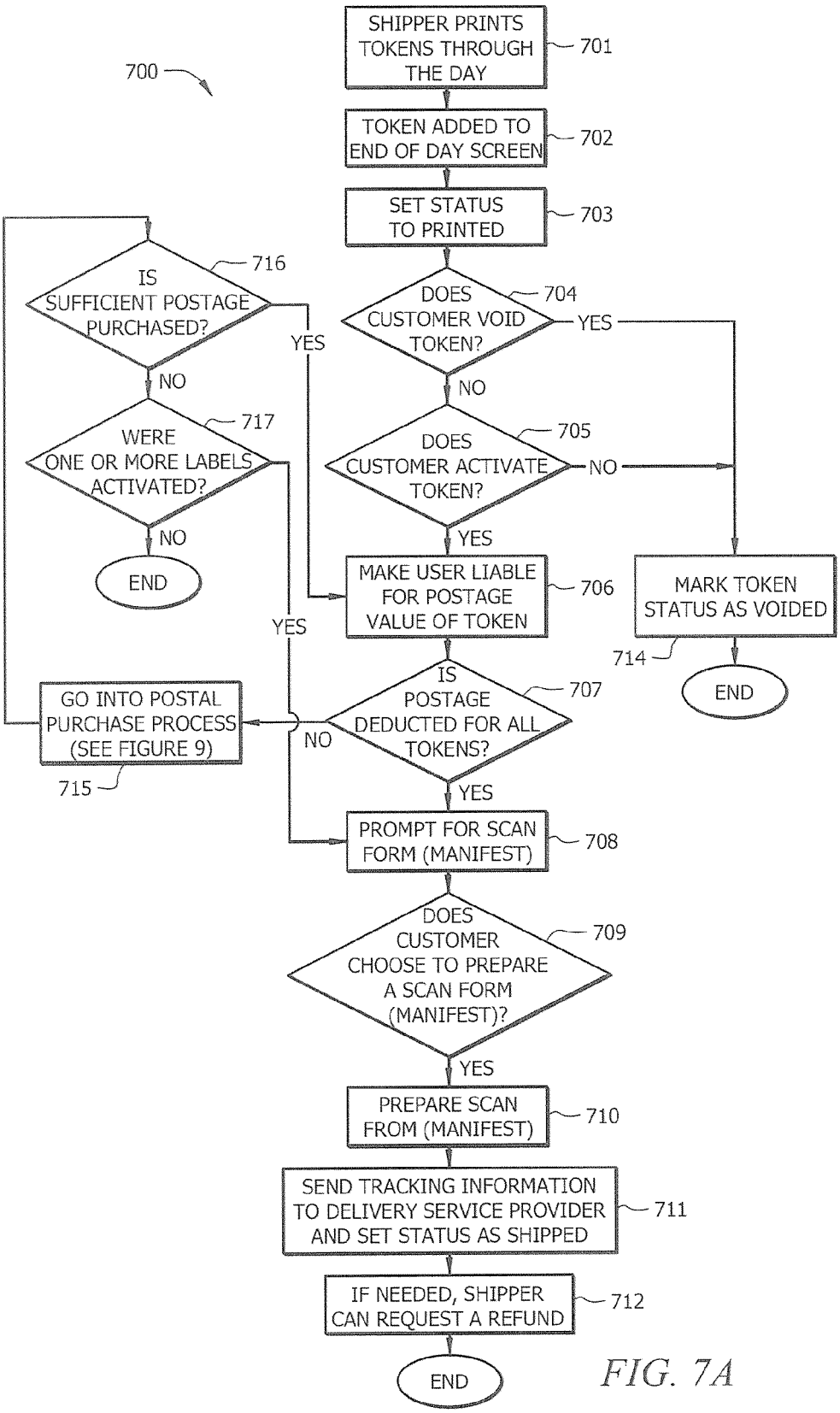
FIGS. 7A and 7B depict various methods adapted to provide payment for a postage indicium after the token has been created and/or printed, but before a postal item associated with the token has been handed to a delivery service.

Another embodiment for payment of postage value after token generation is shown in FIG. 7A. In this embodiment, postage is purchased subsequent to the generation and printing of a token and prior to transferring control of a mail item to the delivery service. Embodiments, such as FIG. 7A, could be offered to a select group of shippers, namely high-value and/or high-volume shippers. Thus, those shippers will not have to purchase postage upfront for tokens or labels comprising tokens. However, such shippers may maintain a meter balance to purchase postage when appropriate.

In block 701, the shipper prints unactivated tokens as needed. When printing tokens, the shipper could just the token itself or could print a label for the mail item wherein the label comprises the token therein. The label could additionally include the recipients address, return address, handling instructions, and other shipping information. Thus, the label could be printed on a single printing medium (e.g. a piece of paper) including all shipping information necessary for shipping a package including the token. In block 702, each token is added to a shipping manifest that may be displayed by a graphic user interface (GUI) on an end-of-day screen. As above, the software operable for printing the unactivated tokens may be client based (e.g. local client software) or web based (e.g. a web browser). The status of the printed tokens may be marked as printed on the shipping manifest, block 703. Note that actual printing may occur at locations other than the shipper's location. For example, printing may occur at a retail store that prints the tokens on blanks for the shipper. The facilitator may print the tokens on labels and send them to the shipper. The facilitator may also print to a retail store network printer. Thus, the shipper may be using preprinted tokens.

The shipper may indicate that one or more particular tokens were incorrectly printed. For example, a mistake may have been made in addressing the recipient, or the wrong item was placed into the postal item. In any event, the shipper may void a token because of such a mistake or for other reasons, block 704. A token could be voided by the system upon receiving, at the server, token voiding information. In one embodiment, a token could be voided using the GUI by selecting a token listed in the manifest displayed on the screen and indicating to the system that the token should be voided. For example, the GUI could include a void button or void check-box on the manifest screen to allow the user to make a status change. A scanner may also be used to void a token. The scanner could comprise a function which voids tokens then the token or its associated delivery confirmation number is scanned. Alternatively, a token may be voided by simply not activating the token. The system could have a time limit associated with a token, such that if the token is not activated within the time limit, the token is automatically voided. For example, at the end of every day, every week, or at the end of any predefined time period, all tokens not yet activated could automatically be voided. Alternatively, the automatic voiding could be tied to a user's accounting or reconciliation. For example, when a user does an accounting or reconciliation at the end of a day, week, or month, all unactivated tokens could automatically be voided. Of course, any triggering event could be used to trigger the voiding of unactivated tokens including a time limit, a printed token number limit, a number of misused/abused tokens etc., and the trigger thresholds could be set by the user, service provider, or both. Note that voiding is different from refunding in that the shipper has not yet been charged or otherwise made liable for the postage value. The voided tokens are canceled and, if desired, removed from the manifest, and the status of such tokens are changed to voided, block 714. Note that marking a token as a void token may be undone by changing the token's status back to printed. If the shipper has voided all of the tokens, then the process ends, block 713, if not, then the process 700 continues.

In diamond 705, the shipper activates the tokens of the packages that are desired to be shipped. Note that there may be some indicia tokens that the shipper neither ships nor voids, and thus does not activate. For example, the shipper may decide to delay shipping a package associated with a token for a day or so. One way to address these tokens is to automatically void the tokens at the end of the working day as discussed above, via block 714. This may be done by a batch process at the end of the day that runs after the last possible shipping time in the last time zone of interest, e.g. Hawaii. In this case, the shipper could print another token when they decide to ship the package. Another way to address these tokens is to maintain the printed state for a time period, e.g. 2 weeks. This would allow the shipper to later ship a package with the associated token without having to print a new token. The manifest screen would continue to maintain the token marked with the status of printed, but not activated. The shipper would not be charged, or otherwise made liable for, the postage value of the token until the status changes to activated.

In any event, at the end of the day, or whenever the shipper is ready to send the postal items with the tokens, the shipper activates the desired tokens into postage indicia, block 705. The shipper may activate one or more tokens using the GUI by selecting an activate button associated with the token. Alternatively, the tokens may be activated by a scanner or other activation device. For example, the user could scan the token itself or input information read off the token into an activation device such that the system activates the token. At this point, the facilitator deducts the postage amount from the meter or account of the shipper, or otherwise makes the shipper liable for the postage amount, and the token is activated into a postage indicia as described in detail above, block 706.

Of course, the token need not be activated the day it was printed. For example, the token could be printed on a Monday but not be activated until the next Friday. This is particularly useful for items where the recipient is expected to return a mail item to the sender. For example, a sender may send an invitation to a recipient with an RSVP card included. The included RSVP card could be marked with an unactivated token. Then at some later time, the sender could use the GUI to activate the token into an indicium such that the invitation recipient can mail the RSVP using the now activated indicium. Moreover, if desired, the invitation sender could give the invitation recipient either full or limited access to his account such that the invitation recipient could use a web browser GUI (or a scanner) to activate the token into an indicium prior to or at the time of mailing the RSVP. Thus, the invitation sender can send many invitations with unactivated tokens and only pay postage value for the indicia which are activated.

At optional diamond 707, the process determines whether all of the postage was deducted. If all of the postage is deducted, then the process moves to block 708. If enough postage is not available, the shipper is prompted to buy postage, optional block 715. An example of a process to allow a shipper to buy postage is shown in optional process 900 of FIG. 9. Optional diamond 716 determines if the shipper bought enough postage. If so, then the process returns to block 706 where the postage value can be deducted. If not, then optional diamond 717 determines whether the meter has a sufficient balance to allow for 1 or more of the tokens to be activated. This aspect allows a shipper to ship the packages or some of the packages, as many as the shipper has funds to allow. If some of the tokens can be activated, then the process moves to block 708. If not, then the process ends block 713. Note that the status of tokens that are unactivated and unpaid are changed to void once the shipping date has passed. Diamonds/blocks 707, 715, 716, and 717 are useful in embodiments where the user's account is charged for postage value at the time of activation. In embodiments of the invention, the user may be made liable for the postage value of indicia at the time of activation but charged for the postage value at a later time. In such embodiments, if desired, diamonds/blocks 707, 715, 716, and 717 may be omitted from the system such that block 706 goes directly to block 708.

In block 708, the shipper is prompted for SCAN form or manifest preparation. SCAN forms or manifests may be required by the delivery service provider. Alternatively, the user may desire SCAN forms or manifests for accounting purposes or to show proof of purchase for various reasons. If the user does not want a SCAN form or manifest, Diamond 709 allows a shipper to skip SCAN form or manifest preparation. If the shipper decides to prepare the SCAN form or manifest, then the form is prepared in block 710. In block 711, the package statuses are then marked as shipped. The tracking information for these packages is sent to the delivery service.

Note that at this point in the process, the postage indicium can no longer be voided. Thus, distinguishable from delivery services using non-indicia bearing labels, (e.g. FedEx or UPS), the user is charged for the indicia postage value whether or not the mail item is shipped. In a non-indicia bearing label system (e.g. UPS or FedEx labels), a user is traditionally only charged for shipment costs if the package is actually shipped.

If needed, however, a shipper can request a refund via refund graphical user interface, block 712. The process then ends, block 713.

Figure 7B:
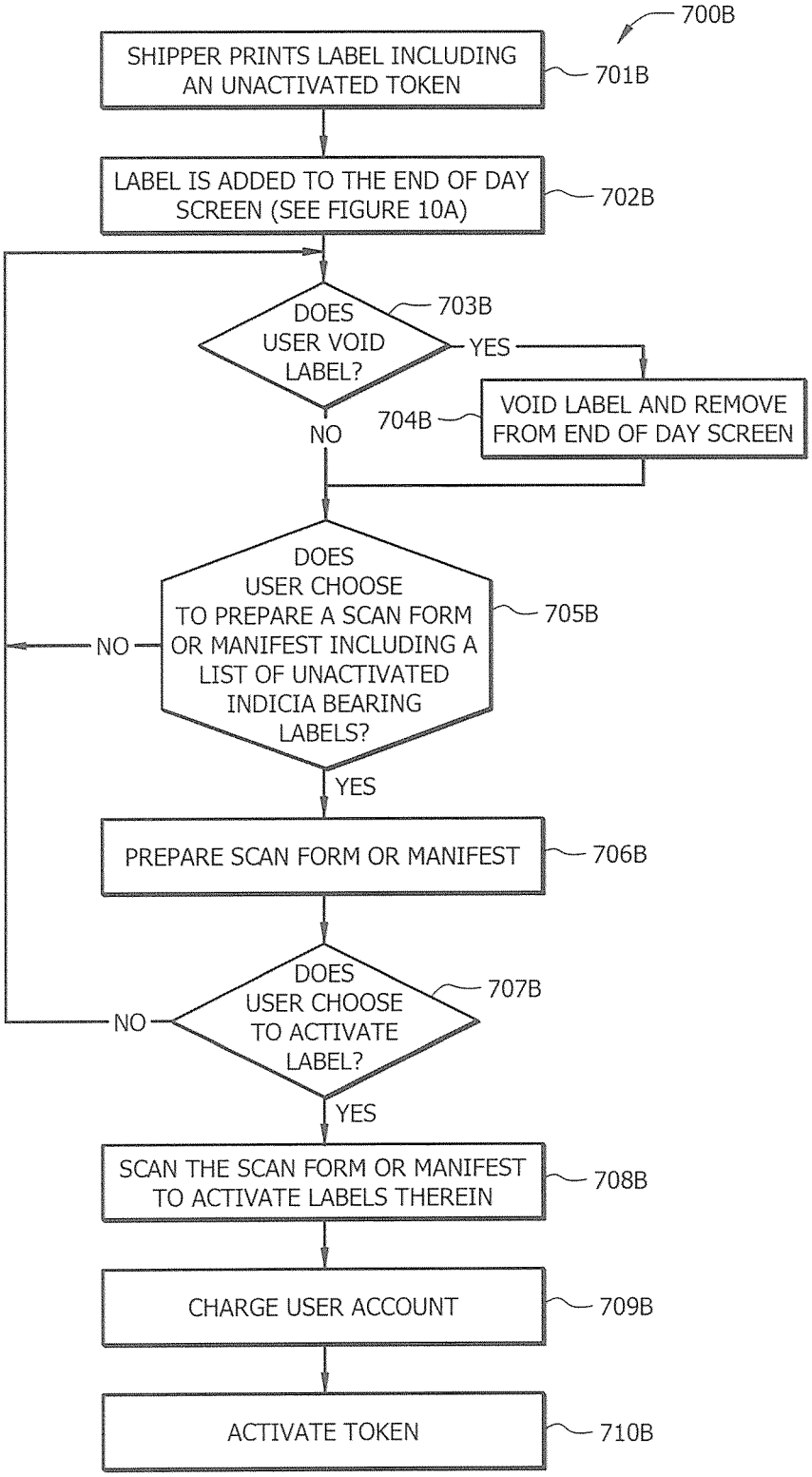

FIG. 7B shows an alternative method for activating tokens. This method uses a SCAN form or printed manifest which is printed prior to activation. In block 701B the shipper prints tokens throughout the day. The shipper can use client based software or web based software (e.g. using a web browser) to print the tokens. As above, if desired, the user could print a shipping label that comprises the token. When the token is printed, the token is added to the end of the day screen displayed by the GUI, block 702B. Using this screen, the user could void a token if desired. A user choose to void a token because it was printed by mistake, attached to the wrong mail item, associated with the wrong recipient, ect. The GUI could provide a void button, a void check box, ect. to allow for token voiding. Diamond 703B determines whether the user voided a token. If the user indicated that the token should be voided, then the system voids the token, and, if desired, the GUI could remove it from the end of day screen as shown in block 704B. Alternatively, the GUI may show the token on the end of day screen with a voided status. Voided tokens can be unvoided using the GUI, if desired. If a voided token is un-voided, the status of the unvoided token would once again be displayed on the end of day screen as printed.

In this embodiment, the user can be given a prepare SCAN form option prior to activating the labels, diamond 705B. If the user does not indicate he wants a SCAN form generated, then the method returns to step 703B.

Diamond 705B determines whether the user wants a SCAN form (or manifest) prepared prior to token activation. If the user wants a SCAN form prepared, the system prepares the SCAN form (or manifest) and prints the form, block 706B. The SCAN form (or manifest) lists each token which was printed, not voided, and not yet activated. The printed form could provide a list of tokens and corresponding barcodes for each token. Additionally or alternatively, the printed form could have a "form barcode" representing all tokens listed in the form. Additionally or alternatively, the tokens could be represented by its substantially unique code, delivery confirmation number, and/or signature confirmation number, unactivated IBI, etc. Any or all of this information could be incorporated into the barcode and/or be in human readable format. Additional information could be used in identifying the token on the form such as, but not limited to, addressee information, addressor information, postage indicia information, confirmation numbers, weight, class, dimensions, account information, etc.

When activating the tokens listed on the form, the user could scan the "form barcode", block 708B. Because the form barcode represents all tokens listed in the form, scanning the form barcode activates into postage indicia, all the token listed in the form. Alternatively, because the barcode information could also be provided in a human readable form, the user could manually input the barcode information into an activation device.

The user may want to activate some but not all of the tokens listed in the form. Thus, the user could selectively scan the individual barcodes of only the selected tokens listed on the form, block 708B. Because a form may include a barcode for each token, by scanning the individual barcode associated with a single token, the user can active some tokens listed in the form while leaving other tokens listed on the form unactivated. Again, because the information in the barcodes could also be shown in human readable format, the selected tokens could be selectively activated by a user manually inputting the information into an activation device. Note that at any point after printing a token, the token can be activated by the method shown in FIG. 7A (e.g. activation using the GUI, through scanning the token, ect). Further, note that tokens can be activated before or after they are affixed to a package. These alternative methods of activating tokens remain available even if the user chooses to have a SCAN form or manifest printed before the tokens are activated as shown in FIG. 7B.

Once a token or tokens are activated, the user is made liable for the postage value of all activated indicia and tracking information can be sent to the delivery service provider. Info is made available to user Block 709B shows one example of making the user liable wherein the user's account is debited for the amount of activated postage value. At this point, the token is converted into indicia, as described above, and can no longer be voided. If the user does not want to be liable for the postage value of the activated indicia, the user would need to request a refund.

Figure 8:
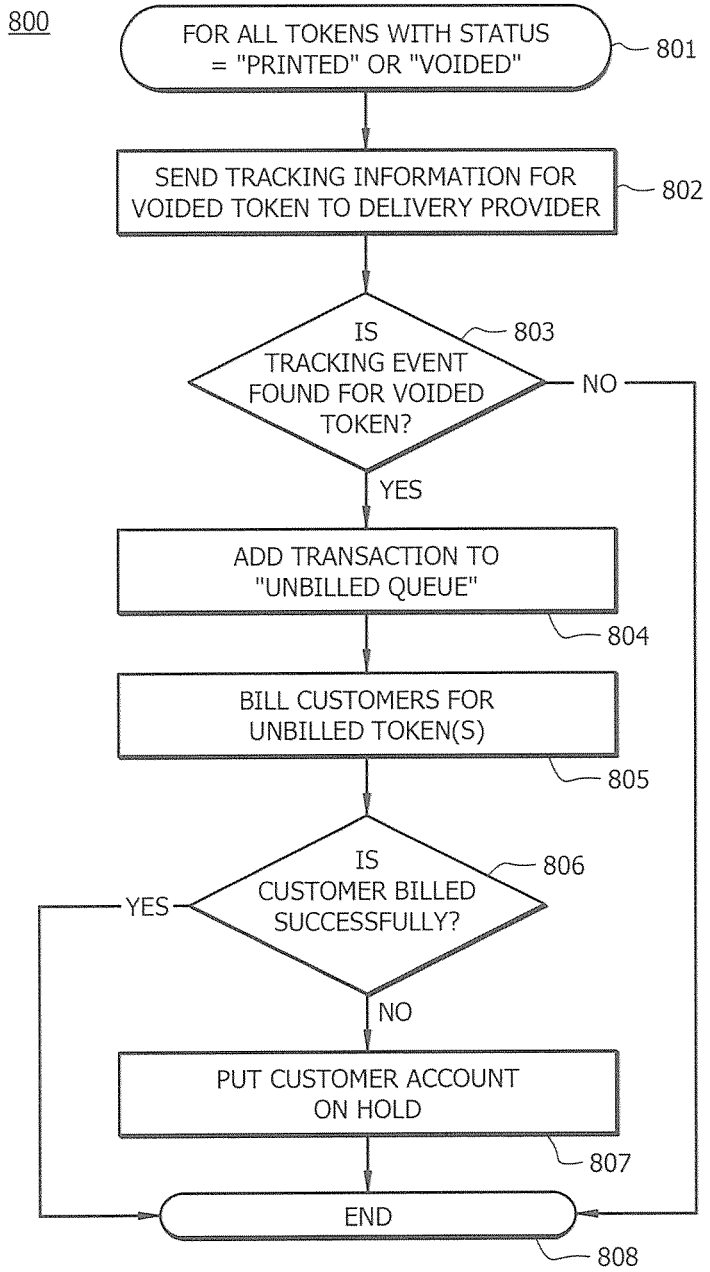
FIG. 8 depicts a method of auditing tokens that have been used in mailing a mail item.

In the processes of FIGS. 7A and 7B, a shipper may void tokens or leave token unactivated. As such, in some instances, a shipper may inadvertently or fraudulently use voided or unactivated tokens. FIG. 8 depicts an auditing process to detect the use of voided or unactivated tokens, and debit shippers for the tokens. The process 800 begins in block 801 by tracking tokens with the status of printed or voided. Tracking information for such tokens is provided to the delivery service at the end of the day, at the end of a time period, when a SCAN form (manifest) is scanned, when a delivery confirmation number is scanned or otherwise provided to the system, when the shipper decides to ship postal items, ect. block 802. Information on the voided and unactivated tokens may be maintained by the delivery service for a period of time, e.g. two weeks or 30 days, and then discarded. If desired, the information can be sent to the postage provider such that the postage provider can track tokens and/or mail items, and can keep track of when and if various tokens are activated, paid for, or being fraudulently used. While processing the mail items in the mail stream, the delivery service scans or otherwise tracks postal items, or a sample of postage items and the information is used by either the delivery service provider or the postage service provider to determine whether any of the postal items comprise tokens listed as void or not yet activated, diamond 803. If not, then the postal items proceed through the mail stream to the recipient, and the process ends block 808.

If the delivery service or postage service provider detects a void or unactivated token being used on a postal item in the mail stream, then the process adds a transaction to an unbilled queue for the shipper, block 804. The shipper is then billed for the token by debiting the shipper's account, or otherwise making the user liable for the token, block 805. The process then determines if the shipper has been properly billed, diamond 806, if so then the process ends, block 808. If not, then the account of the shipper is placed on hold, block 807.

Additionally or alternatively, the audit system could track activated indicia to determine whether an activated indicia includes the proper postage. When scanning the postage items, or sample of postage items, the delivery service provider could analyze (e.g. using a scanner and/or scale) the mail item and the postage amount to determine whether a postage payment error occurred (e.g. overpayment for postage or underpayment for postage). If the system determines a postage payment error occurred, the system could log the error and bill the user for any underpayment or credit the user for any overpayment. Moreover, the system could have predefined user preferences stored wherein the user could establish ahead of time what action should be taken by the system should a payment error occur. The handling of payment errors and user preferences regarding payment error is described in U.S. application Ser. No. 11/616,546 filed Dec. 27, 2006, entitled "System and Method for Handling Payment Errors with Respect to Delivery Services," and incorporated herein by reference.

Process 800 may include a predetermined threshold for misused tokens. If the shipper is using more than a certain number of voided or unactivated tokens over a time period, e.g. each month, then the account may be put on hold. Process 800 may also send an email or other communication to the shipper indicating that unactivated or voided tokens have been used. The account may have all misused tokens remarked as shipped but unpaid. The account may be debited for, or otherwise held liable for, the postage value amount of some or all of the tokens so marked.

In block 807, the shipper may be given an opportunity to add sufficient funds to the account before the account is placed on hold.

Figure 9:
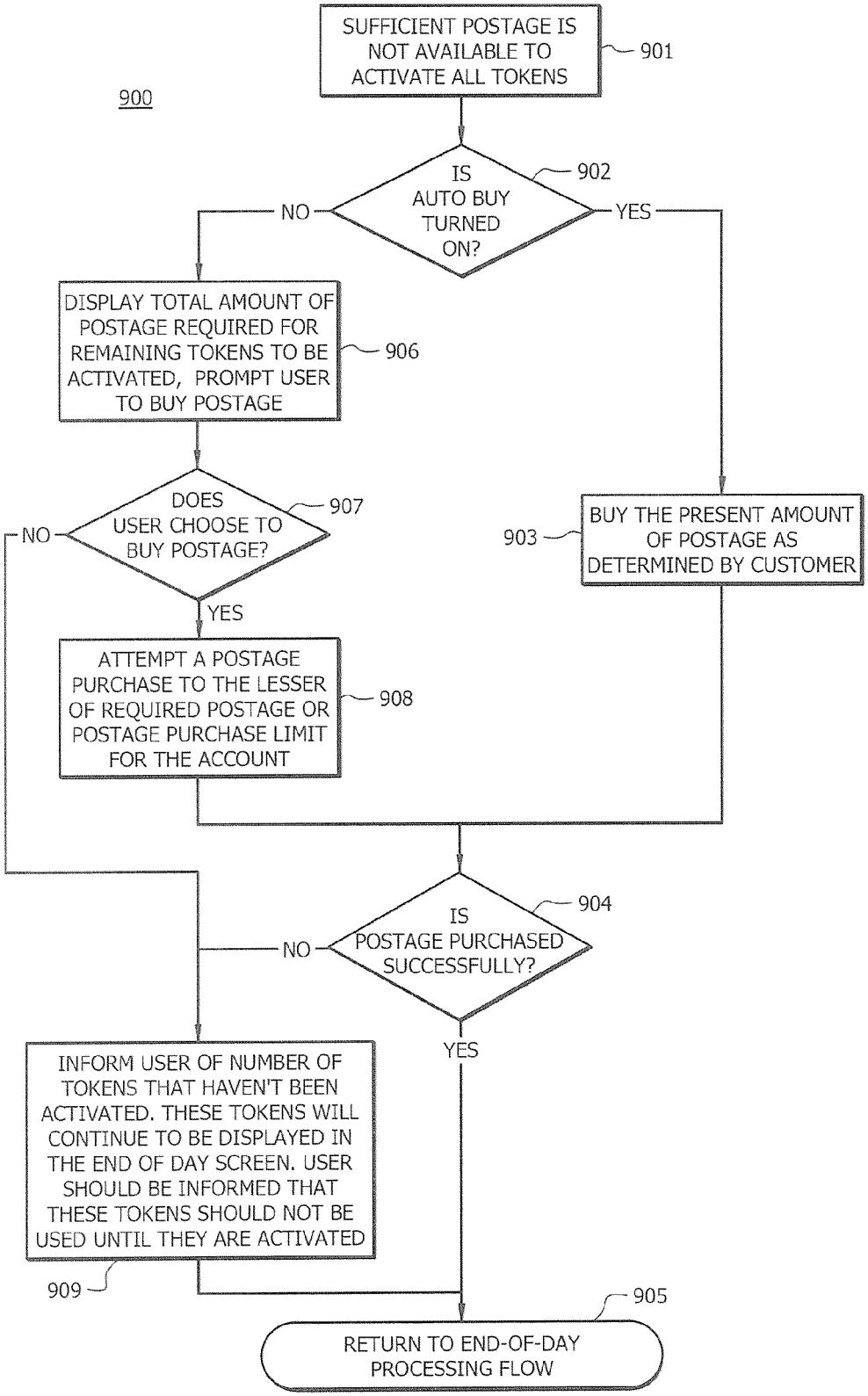
FIG. 9 depicts another method adapted to provide payment for a postage indicium after the indicium has been created and/or printed.

FIG. 9 depicts an alternative embodiment for a portion of the process 700 of FIG. 7A. Process 900 begins with the shipper using a post creation billing process. Process 900 begins with a determination that the shipper's account does not have the required postage to activate the previously created and/or printed postage tokens, block 901. Diamond 902 checks if the shipper has selected to automatically buy postage when needed. If so, then the process moves to block 903 to buy the necessary postage or a preselected amount of postage. If not, then the process displays a GUI that indicates the amount of needed postage and prompts the shipper to buy the postage, block 906. At block 907, the process determines whether the user chooses to buy postage. If the shipper chooses to buy postage, then the process moves to block 908 and buys the postage. If not, then the process moves to block 909, and informs the shipper that the printed tokens are not activated and should not be used. The process then returns to process 700 of FIG. 7A.

From blocks 903 or 908, the process determines whether the postage was successfully purchased, diamond 904. If not, then process moves to block 909. If so, then the process returns to process 700 of FIG. 7A.

The automatic buy-postage aspect may allow the shipper to buy a preselected (by the shipper) amount of postage, buy the exact postage needed, or buy a preselected (by the facilitator) amount of postage. This aspect may also operate independently of the processes 700, 700B, and 900 to automatically buy postage if the meter or account is reduced to a predetermined (by either the shipper or the facilitator) value. The processes of FIGS. 7A, 7B, 8, and 9 may operate with any of the systems described herein.

Figure 10A:
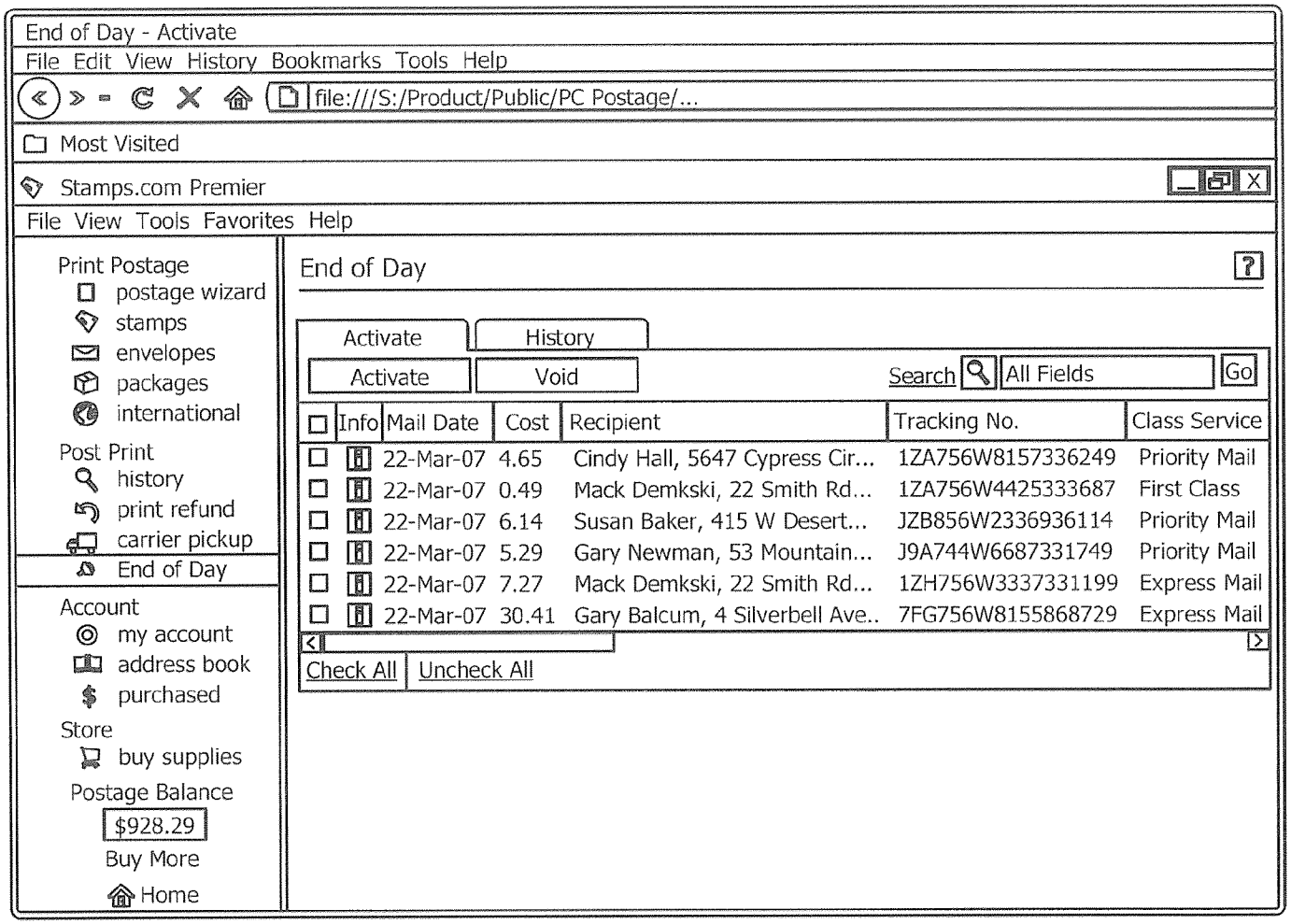

As explained, the systems disclosed herein may operate to present a graphical user interface (GUI) screen to a shipper via a display. FIGS. 10A-10B depict examples of graphical user interface screens that may be presented to a shipper during the operation the disclosed systems. FIG. 10A depicts the end of day manifest screen, as described in FIGS. 7A and 7B, that allows a user to activated and void tokens. If the user selects activate for a given token, then the system activates the token into an indicium, as described above. If the user selects the void option for a particular token, then the system voids token as described above, and that token is not valid for mailing. Of course, as explained above, the system can give the user an opportunity to change the status of any or all of the voided tokens to un-voided (e.g. printed) or activated.

FIG. 10B shows a transaction history after the user has selected activate and/or void for particular tokens. The transaction history can be used by the user and/or postage service provider and/or the delivery service provider for proof of payment, accounting, statistical analysis, shipment tracking, postage verification, indicia validation, and the like.

As explained above, there could be other methods for activating indicia, any one of which or any combination of which could be made available to the customer (e.g. indicia scanning, form scanning, etc.). The customer can select which of the methods are made available to him, or the facilitator could make the selection. A fee could be charged in association with which and how many activation options are made available to the user.

In addition to the activation methods explained above, the user could set up the system for end-of-day activation. Under this method, all printed tokens that have not been voided will automatically be activated at the end of the day. Alternatively, the end-of-day activation could be configured such that all tokens which have not been activated at the end of the day are automatically voided. End-of-day could be set to occur every day at a certain time (e.g., the close of business, the time of last shipment pickup, midnight, etc.) such that every day at the designated time each printed token is either activated or voided (dependent on how the system is configured). Of course, end-of-day activation does not have to occur at the end of every day. A time limit or other event could be a triggering event such that activation occurs more or less often then every day (e.g., only on business days, only on Fridays, twice a day, every four hours, once a threshold number of tokens are printed, etc.).

FIG. 11 shows an example of a mail item 1101. Attached to or printed on mail item 1101 is token 1103. Destination address information 1104 is shown and sender address information 1105 is shown. Below destination address information 1104 is shown delivery confirmation number 1102. Delivery confirmation number 1102 could be located in alternative locations on the envelope.

Use of Delivery Confirmation Numbers

As described above, substantially unique identification information is often used by the delivery service provider in tracking mail items. For example, a delivery confirmation number may be generated and associated with a mail item for use by the delivery service provider in tracking the location of the item throughout the delivery process and/or confirming the delivery event.

In embodiments of the invention, the postage provider can generate the delivery confirmation number and use the delivery confirmation number for tracking and for token activation. Delivery confirmation numbers are different from POSTNET numbers which are also used by delivery service providers. For example, delivery confirmation numbers are made up of a bar code called the 4-state customer barcode the trackers of which include the ascender, descender, and full bar. In contrast, POSTNET numbers are created using different barcode fonts and comprising different information. Thus, delivery barcodes and POSTNET numbers are different and should not be confused for each other herein. Delivery confirmation numbers are generated from a computer, a server, or a system comprising computer processing apparatuses. This computer or server may be the same computer or server which generates the token which will be associated with the delivery confirmation number or could be a separate computer or server. When generated remotely, a server can generate the delivery confirmation number and send the delivery confirmation number to a client computer for printing. The server can send one delivery confirmation number at a time or a batch of delivery confirmation numbers at once.

The delivery confirmation number is associated with a particular token, and can be generated at the same time that the token is generated. The delivery confirmation number can be generated at a time before or after its associated token was generated and be associated with its associated token at some later point in time. Regardless of whether the token and delivery confirmation number were generated together or separately, the association between the token and delivery confirmation number is stored by the postage service provider. The association can be stored on any computer readable medium for example in a database located on a computer processing apparatus. Also, if activated token indicia are being generated and/or printed, the delivery confirmation can be generated for association with an activated token indicia, if desired.

After the delivery confirmation number is generated, the delivery confirmation number is sent to the delivery service provider (e.g. USPS) such that the delivery service provider can use the delivery confirmation number for their own purposes, such as their tracking of the delivery, their confirmation of delivery events, their compilation of delivery statistics, etcetera. As such, the delivery service provider can use this postage service provider generated delivery confirmation number in the same manner as if the delivery service provider themselves had created the delivery confirmation number.

At some point, the delivery confirmation number is printed. The delivery confirmation number can be printed on a label, on an envelope, or on any other print medium discussed herein. The delivery confirmation number can be printed at the same time or at a different time from when the associated token is printed. The delivery confirmation number can be printed on the same printing medium as the token or on a separate printing medium. The delivery confirmation number can be printed by the same printer as the token or a different printer.

During or after printing, the delivery confirmation number is attached to (or otherwise associated to) the same mail piece that its associated token is attached to. As such, the mail item can bare both the token and the delivery confirmation number. At some point there after (but before control of the mail item is transferred to the recipient) the delivery confirmation number is scanned, entered into a GUI, received by an RFID reader, or otherwise input into the system. The delivery service provider may receive the delivery confirmation number at the time of pick up, the time of delivery, or at any time between for tracking purposes, at which point the tracking information will be provided to the delivery service provider's system or systems. This information can be forwarded from the delivery service provider's system or systems to the postage provider's system or systems. Upon receipt of the delivery confirmation number information, the postage provider can use the delivery confirmation number information in activating the token using any of the activation methods disclosed herein.

Further, the postage provider could make the delivery confirmation number information available to the shipper. The shipper could use the GUI, or a web browser, or interface provided by the postage service provider to retrieve the information. Additionally or alternatively, client software provided by the postage provider could automatically keep the shipper informed about the activation of and delivery status of the mail item.

For example, upon scanning of the delivery confirmation number, information about the time, date, place, token activation, and other status information can be sent to a server of the postage service provider. This information could be used to automatically update the status of the mail item in the server. The server could send that information to client software being used by the shipper. Once received, the GUI could indicate the status of the mail item and/or token to the shipper. For example the GUI could change the status of a token from unactivated to activated and show the time, location, and date of the activation. The GUI could also indicate to the user the location of the token (and therefore the mail item attached to the token), both before and after activation, at various points in the mail stream including at the point of delivery.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method comprising:

generating a manifest which identifies a plurality of unactivated tokens, wherein said identifying comprises:

individually identifying each unactivated token of the plurality of unactivated tokens at least by a scannable individual identifier which only identifies the unactivated token; and commonly identifying a group of more than one of the plurality of unactivated tokens at least by a scannable common identifier which identifies the group of more than one of the plurality of unactivated tokens; and activating the group of more than one of the plurality of unactivated tokens into activated postage indicia at least by:

scanning the scannable common identifier of the manifest which identifies the group of more than one of the plurality of unactivated tokens, wherein the manifest itself is not operable to be activated into activated postage indicia; and based at least on the scannable common identifier, storing, on a memory, an indication that the plurality of previously unactivated tokens identified by the scannable common identifier have been changed from being unactivated tokens to being valid postage indicia.

2. The method of claim 1 wherein the scannable common identifier identifies some of the plurality of unactivated tokens, but not all of the plurality of unactivated tokens.

3. The method of claim 1 further comprising:

making a user account monetarily liable for postage value of the activated postage indicia after activation.

4. The method of claim 3 wherein said making a user monetarily liable comprises debiting the postage value of the activated postage indicia from the user account.

5. The method of claim 1 further comprising:

voiding an unactivated token at least by scanning the individual identifier of the manifest which identifies the unactivated token.

6. The method of claim 1 further comprising:

voiding a group of more than one of the plurality of unactivated tokens at least by selecting a void option.

7. The method of claim 1 further comprising:

upon occurrence of a triggering event, activating, without user intervention at the time of the triggering event, all of the plurality of unactivated tokens which are not activated at the time of the triggering event and not voided at the time of the triggering event.

8. The method of claim 7 wherein said triggering event is an expiration of a time period.

9. The method of claim 1 further comprising:

upon occurrence of a triggering event, voiding, without user intervention at the time of the triggering event, all of the plurality of unactivated tokens which are not activated at the time of the triggering event and not voided at the time of the triggering event.

10. The method of claim 9 wherein said triggering event is an expiration of a time period.

11. A system comprising:

a plurality of unactivated tokens configured for attachment to a plurality of mail items;

one or more computer processor configured to generate a manifest which identifies the plurality of unactivated tokens, wherein the manifest itself is not operable to be activated into activated postage indicia, wherein said identifying comprises:

individually identifying each unactivated token of the plurality of unactivated tokens at least by a scannable individual identifier which identifies only the unactivated token; and commonly identifying a group of more than one of the plurality of unactivated tokens at least by a scannable common identifier which identifies the group of more than one of the plurality of unactivated tokens; and a scanner configured to scan the scannable common identifier;

wherein the one or more computer processor is further configured to activate the group of more than one of the plurality of unactivated tokens into activated postage indicia at least by:

receiving the scanned scannable common identifier; and based at least on the scanned scannable common identifier, storing, on a memory, an indication that the plurality of previously unactivated tokens identified by the scannable common identifier have been changed from being unactivated tokens to being valid postage indicia.

12. The system of claim 11 wherein the scannable common identifier identifies some of the plurality of the unactivated tokens, but not all of the plurality of unactivated tokens.

13. The system of claim 11 wherein the one or more computer processor is further configured to make a user account monetarily liable for postage value of the activated postage indicia after activation.

14. The system of claim 13 wherein said making a user monetarily liable comprises debiting the postage value of the activated postage indicia from the user account.

15. The system of claim 11 wherein the one or more computer processor is further configured to void a group of more than one of the plurality of unactivated tokens in response to a user selecting a void option.

16. The system of claim 11 wherein upon occurrence of a triggering event, the one or more computer processor is configured to activate, without user intervention at the time of the triggering event, all of the plurality of unactivated tokens which are not activated at the time of the triggering event and not voided at the time of the triggering event.

17. The system of claim 16 wherein said triggering event is an expiration of a time period.

18. The system of claim 11 wherein upon occurrence of a triggering event, the one or more computer processor is configured to void, without user intervention at the time of the triggering event, all of the plurality of unactivated tokens which are not activated at the time of the triggering event and not voided at the time of the triggering event.

19. The system of claim 18 wherein said triggering event is an expiration of a time period.

* * * * *